US012735816B2

(12) United States Patent
Jessup et al.

(10) Patent No.: US 12,735,816 B2
(45) Date of Patent: Sep. 15, 2026

(54) SEAMED STRUCTURES WOVEN ON A BIAS AND CORRESPONDING SYSTEMS AND METHODS

(71) Applicant: ATEX TECHNOLOGIES, INC., Pinebluff, NC (US)

(72) Inventors: Mark Jessup, Whispering Pines, NC (US); Laura Dailey, Southern Pines, NC (US); Morgan Gwaltney, Pinehurst, NC (US); Paul Van Hulle, Pinehurst, NC (US)

(73) Assignee: ATEX TECHNOLOGIES, INC., Pinebluff, NC (US)

( * ) Notice: Subject to any disclaimer, the term of this patent is extended or adjusted under 35 U.S.C. 154(b) by 0 days.

(21) Appl. No.: 19/413,494

(22) Filed: Dec. 9, 2025

(65) Prior Publication Data

US 2026/0146374 A1 May 28, 2026

Related U.S. Application Data

(63) Continuation of application No. 19/490,691, filed as application No. PCT/US2024/032900 on Jun. 7, 2024.

(Continued)

(51) Int. Cl.

| | |
|---|---|
| ***D03D 13/00*** | (2006.01) |
| ***D03D 15/56*** | (2021.01) |
| *D03D 11/02* | (2006.01) |

(52) U.S. Cl.

CPC ..... *D03D 13/004* (2013.01); *D03D 15/56* (2021.01); *D10B 2509/00* (2013.01)

(58) Field of Classification Search

CPC ... D03D 13/004; D03D 15/56; D10B 2509/00
See application file for complete search history.

(56) References Cited

U.S. PATENT DOCUMENTS 1,538,836 A * 5/1925 Mccarrel ..... A41B 5/00 139/386
1,820,293 A * 8/1931 Albert ..... A41B 9/00 2/78.2

(Continued)

FOREIGN PATENT DOCUMENTS

JP S6183344 A 4/1986

OTHER PUBLICATIONS

Dec. 4, 2024 Search Report issued in International Patent Application No. PCT/US2024/032900; 3 pp.

(Continued)

*Primary Examiner* — Robert H Muromoto, Jr.
(74) *Attorney, Agent, or Firm* — Nelson Mullins Riley & Scarborough LLP

(57) ABSTRACT

Systems and methods for manufacturing a woven seamed structure are provided herein. A method includes providing a plurality of threads parallel to a warp axis and providing a weaving thread, and then weaving the weaving thread into the plurality of threads back and forth in directions parallel to a weft axis. The weaving thread, in a machine direction, changes patterns at positions along the weft axis that change gradually or intermittently as the weaving thread is woven in the machine direction such that a first transition line and a second transition line, respectively, are formed at non-zero angles from the warp axis and the weft axis. This forms a woven seamed structure with a central axis that extends along a non-zero angle from the warp axis or the weft axis, such example woven seamed structure exhibiting enhanced stretchability and conformance.

25 Claims, 24 Drawing Sheets

Related U.S. Application Data

(60) Provisional application No. 63/507,232, filed on Jun. 9, 2023.

(56) References Cited

U.S. PATENT DOCUMENTS

| | | | | | |
|---|---|---|---|---|---|
| 2,008,285 | A * | 7/1935 | Kraus | A47G 9/0253 | 383/105 |
| 2,465,584 | A * | 3/1949 | Gamer | A41D 25/001 | 2/146 |
| 3,060,949 | A * | 10/1962 | Moss | E04H 15/58 | D25/56 |
| 4,668,545 | A | 5/1987 | Lowe | | |
| 5,671,935 | A * | 9/1997 | Berger | D06H 5/00 | 280/743.1 |
| 7,814,598 | B2 * | 10/2010 | Dua | A43D 8/00 | 36/45 |
| 8,733,406 | B2 * | 5/2014 | Hannes | D03D 21/00 | 139/232 R |
| 2009/0311462 | A1 * | 12/2009 | Goering | B29B 11/16 | 442/205 |
| 2013/0304023 | A1 * | 11/2013 | Schmitt | A61B 17/88 | 604/506 |
| 2016/0281273 | A1 | 9/2016 | Candrian-Bell et al. | | |
| 2018/0171517 | A1 * | 6/2018 | Debaes | D03D 27/06 | |
| 2020/0125777 | A1 * | 4/2020 | Cirio | G06F 30/20 | |

OTHER PUBLICATIONS

Dec. 4, 2024 Written Opinion of the International Searching Authority issued in International Patent Application No. PCT/US2024/032900; 8 pp.

Jul. 14, 2026 Office Action issued in Japanese Application No. 2025-571471; 9 pp.

* cited by examiner

SEAMED STRUCTURES WOVEN ON A BIAS AND CORRESPONDING SYSTEMS AND METHODS

CROSS-REFERENCE TO RELATED APPLICATION(S)

The present application claims priority to and is a continuation of U.S. application Ser. No. 19/490,691, entitled "SEAMED STRUCTURES WOVEN ON A BIAS AND CORRESPONDING SYSTEMS AND METHODS", filed Dec. 5, 2025, which is a 35 U.S.C. § 371 U.S. National Stage Application of International Application No. PCT/US2024/032900, entitled "SEAMED STRUCTURES WOVEN ON A BIAS AND CORRESPONDING SYSTEMS AND METHODS", filed Jun. 7, 2024, which claims priority to U.S. Provisional Application No. 63/507,232, filed Jun. 9, 2023, entitled "Systems and Methods for Forming Tubes Woven on a Bias"; the contents of each being incorporated herein by reference herein in its entirety.

FIELD OF THE INVENTION

Example embodiments of the present invention generally relate to woven seamed structures and, more particularly to, forming woven seamed structures at a non-zero angle to achieve a higher degree of stretchability, such as is beneficial for implantation into a patient's body.

BACKGROUND

Seamed structures (e.g., structures with one or more transition lines, seams, joins, etc.) are often woven on a loom so that they can be used for various purposes, such as for implantation into a body to, e.g., repair or replace a blood vessel, heart valve, or other vascular or tissue repair. In this regard, such seamed structures may form one or more conduits, openings, or chambers for holding or enabling passage of fluid, such as blood or other bodily fluids. When such seamed structures are woven, a weaving thread is woven in a desired pattern into a plurality of threads that are stretched parallel to a warp axis. When this is done, the weaving thread is continuously woven back and forth in directions parallel to a weft axis such that the woven seamed structure is formed. Depending on the weaving design, one or more seams are formed to define a body therebetween, with the body having a central axis (e.g., a central axis of one or more chambers/conduits of the body) that is parallel to the warp axis or parallel to the weft axis. Seamed structures woven in this manner have a limited degree of stretchability or compliance, but the stretchability is not high enough for certain applications.

BRIEF SUMMARY

As noted above, woven seamed structures are used for various purposes, such as for implantation into a body. Depending on the desired usage, stretchability or compliance may be desirable. For example, when woven seamed structures are used as vascular grafts, valve skirts or other conduits for implantation into a body, a higher degree of stretchability is more desirable to achieve an effect in the body that is more similar to a native blood vessel or tissue compliance.

When such grafts are implanted, however, the dimensions and conformance of the graft is critically important. Particularly, the graft needs to be sized so that when the implantation is complete, the graft acts as an organic blood vessel would act in allowing blood to freely flow therethrough. However, the graft can't be so rigid that it may affect nearby tissue, organs, blood vessels, or other medical devices (e.g., additional grafts). Along similar lines, if a graft is too long or large, it may be prone to kinking or enfolding. On the opposite end, if the graft is too small, it may cause unnecessary stress on body tissue, etc. as it stretches to and/or it may be more prone to rupture or tear. Accordingly, stretchability of such grafts is important to aid in implantation, deal with the particularities of the body it is being implanted into, adjust for tolerances, and/or to act more like the native blood vessel in which it is implanted.

Notably, in addition to usefulness as grafts, providing for increased stretchability and compliance in woven structures is useful in many different applications, such as for attachment and use with other medical devices, such as heart valves skirts. Additionally, however, a woven structure according to various embodiments is also useful in other example applications, such as valve conduits, stents, bridging stents, embolic protection devices, catheters, scaffolds, connective tissue replacement, or other implantable prosthesis. In this regard, in many such additional circumstances, some of the same issues of dimensions and/or conformance of the woven structure are critically important (e.g., for heart valve skirts). Accordingly, various embodiments of the present invention are beneficial for such circumstances as well.

Some example embodiments of the present invention include a seamed structure that is woven such that it has a central axis that forms a non-zero angle with a warp axis or with a weft axis on a weaving machine. Seamed structures woven in this way may be more stretchable in their longitudinal and circumferential directions. For example, the current disclosure describes a woven seamed structure, and processes for manufacturing a woven seamed structure, that is woven by weaving a weaving thread into a plurality of threads such that certain ones of the plurality of threads are woven differently by the weaving thread. This forms transition lines that have non-zero angles with respect to the warp axis and the weft axis, which can be designed to be woven as a seam to form a woven seamed structure on the weaving machine. Notably, such transition lines can be formed into any type of line, such as straight (e.g., linear), curved, curvy, winding, etc. The woven seamed structure accordingly forms a body that can act as a conduit or chamber (or multiple conduits and/or chambers) depending on the configuration and designed use. The woven seamed structures and processes for forming woven seamed structures that are disclosed herein can include various weaving patterns and/or various materials, and the woven seamed structures can be woven at various non-zero angles with the warp axis.

In this regard, by changing the weaving orientation, this results in complex three-dimensional textile structures that get closer to mimicking human anatomy. Desired properties such as radial expansion and flexibility can be specified and formed into complex shapes and geometries and, in some embodiments, can vary along the body according to desired specifications. As an example, the woven seamed structure can be connected, such as in the center, to form 2 conduits (e.g., 2 hollow tubs) to mimic other body parts like tendons. Along similar lines, one or more ends can be closed for various purposes. Indeed, in some cases, closing one or more portions of an opening or connecting one or more portions of a body of a woven seamed structure can result in providing enhanced strength and/or resistance to unraveling.

Moreover, the entire structure can be adjusted and different weaves or connections can be provided for any purpose, creating flexibility, which is helpful for, for example, orthopedic repair. In this regard, the woven seamed structures can conform to all sorts of anatomical curves and bends, making them extremely valuable.

In an example embodiment, a method for forming a multi-layered structure is provided. The method comprises providing a plurality of threads parallel to a warp axis; providing at least one weaving thread; and weaving the at least one weaving thread into the plurality of threads back and forth in directions parallel to a weft axis, the weft axis being perpendicular to the warp axis. The at least one weaving thread is configured to change between patterns at a first position in a first pick and at a second position in a second pick so as to form a first transition line between the first position and the second position. The first transition line extends at a first non-zero angle from the warp axis. The first transition line is not parallel to the weft axis. The at least one weaving thread is further configured to change between patterns at a third position in a third pick and at a fourth position in a fourth pick so as to form a second transition line between the third position and the fourth position. The second transition line extends at a second non-zero angle from the warp axis. The second transition line is not parallel to the weft axis. The first transition line and the second transition line form at least a portion of a woven seamed structure therebetween. The woven seamed structure defines a central axis that, when extending between the first transition line and the second transition line, extends along a third non-zero angle from the warp axis that is not parallel to the weft axis.

In some embodiments, the woven seamed structure forms a body that includes a first seam formed from the first transition line and a second seam formed from the second transition line. In some embodiments, the body comprises a same pattern. In some embodiments, the body comprises a plurality of patterns.

In some embodiments, the at least one weaving thread is further configured to change between a first pattern and a second pattern at the first position in the first pick and at the second position in the second pick so as to form the first transition line, wherein the at least one weaving thread is further configured to change between a third pattern and a fourth pattern at the third position in the third pick and at the fourth position in the fourth pick so as to form the second transition line. In some embodiments, the first pattern and the second pattern are the same. In some embodiments, the first pattern and the second pattern are different. In some embodiments, the second pattern and the fourth pattern are the same. In some embodiments, the second pattern and the fourth pattern are different. In some embodiments, the first pattern is changed to the second pattern intermittently in a machine direction parallel to the warp axis. In some embodiments, the third pattern is changed to the fourth pattern gradually in the machine direction parallel to warp axis. In some embodiments, changing between the first pattern and the second pattern and the changing between the third pattern and the fourth pattern each comprise at least one of: engaging every-other thread of the plurality of threads to engaging no threads of the plurality of threads; engaging every-other thread of the plurality of threads to engaging all threads of the plurality of threads; engaging no threads of the plurality of threads to engaging every-other thread of the plurality of threads; or engaging all threads of the plurality of threads to engaging every-other thread of the plurality of threads.

In some embodiments, third pattern is changed to the fourth pattern intermittently in the machine direction parallel to the warp axis. In some embodiments, changing between the first pattern and the second pattern and the changing between the third pattern and the fourth pattern each comprise at least one of: engaging every-other thread of the plurality of threads to engaging no threads of the plurality of threads; engaging every-other thread of the plurality of threads to engaging all threads of the plurality of threads; engaging no threads of the plurality of threads to engaging every-other thread of the plurality of threads; or engaging all threads of the plurality of threads to engaging every-other thread of the plurality of threads.

In some embodiments, the first pattern is changed to the second pattern gradually in a machine direction parallel to the warp axis. In some embodiments, the third pattern is changed to the fourth pattern intermittently in the machine direction parallel to the warp axis. In some embodiments, changing between the first pattern and the second pattern and the changing between the third pattern and the fourth pattern each comprise at least one of: engaging every-other thread of the plurality of threads to engaging no threads of the plurality of threads; engaging every-other thread of the plurality of threads to engaging all threads of the plurality of threads; engaging no threads of the plurality of threads to engaging every-other thread of the plurality of threads; or engaging all threads of the plurality of threads to engaging every-other thread of the plurality of threads.

In some embodiments, the third pattern is changed to the fourth pattern gradually in the machine direction parallel to the warp axis. In some embodiments, changing between the first pattern and the second pattern and the changing between the third pattern and the fourth pattern each comprise at least one of: engaging every-other thread of the plurality of threads to engaging no threads of the plurality of threads; engaging every-other thread of the plurality of threads to engaging all threads of the plurality of threads; engaging no threads of the plurality of threads to engaging every-other thread of the plurality of threads; or engaging all threads of the plurality of threads to engaging every-other thread of the plurality of threads.

In some embodiments, the first non-zero angle, the second non-zero angle, and the third non-zero angle are the same.

In some embodiments, the first non-zero angle, the second non-zero angle, and the third non-zero angle are different.

In some embodiments, the method further comprises interlacing together the at least one weaving thread and the plurality of threads at the first transition line to form a first seam and interlacing together the at least one weaving thread and the plurality of threads at the second transition line to form a second seam.

In some embodiments, when formed, the woven seamed structure has a first opening at a first end and a second opening at a second end.

In some embodiments, when formed, the woven seamed structure has a first end and a second end, wherein the first transition line is straight from the first end to the second end, and wherein the second transition line is straight from the first end to the second end.

In some embodiments, the first non-zero angle is an angle ranging from 30 degrees to 75 degrees.

In some embodiments, the first non-zero angle is an angle ranging from 40 degrees to 50 degrees.

In some embodiments, the first non-zero angle is 45 degrees.

In some embodiments, the method further comprises: cutting the at least one weaving thread and the plurality of threads outside of the first transition line to release a first portion of the woven seamed structure; and cutting the at least one weaving thread and the plurality of threads outside of the second transition line to release a second portion of the woven seamed structure.

In some embodiments, the plurality of threads and the at least one weaving thread are comprised of a same material. In some embodiments, the same material is an elastic material.

In some embodiments, the plurality of threads is comprised of a first material, and wherein the at least one weaving thread is comprised of a second material. In some embodiments, the first material has a first modulus of elasticity, and wherein the second material has a second modulus of elasticity that is different than the first modulus of elasticity.

In some embodiments, the at least one weaving thread is woven into the plurality of threads forming a sheet of fabric such that the at least portion of the woven seamed structure is formed in conjunction with the sheet of fabric.

In some embodiments, the woven seamed structure comprises a body including the first transition line and the second transition line, wherein a layer of the woven seamed structure between the first transition line and the second transition line exhibits an increase in stretchability along a length direction of the body of at least 175% compared with an otherwise same second woven seamed structure that was formed with one or more transition lines at a zero angle with respect to the weft axis or the warp axis.

In some embodiments, the woven seamed structure comprises a body including the first transition line and the second transition line, wherein a layer of the woven seamed structure between the first transition line and the second transition line exhibits an increase in elongation along a length direction of the body of at least 20%.

In some embodiments, the woven seamed structure comprises a body including the first transition line and the second transition line, wherein the woven seamed structure is formed of yarn comprising 8-80 denier per yarn, wherein a layer of the woven seamed structure between the first transition line and the second transition line exhibits an increase in elongation along a length direction of the body of at least 200% compared to a second woven seamed structure with transition lines formed at a zero angle with respect to the weft axis or the warp axis, and wherein the second woven seamed structure otherwise comprises the same properties of denier per yarn as the woven seamed structure.

In some embodiments, the woven seamed structure is formed of yarn comprising 200 denier or less. In some embodiments, the woven seamed structure comprises a body including the first transition line and the second transition line, wherein the body of the woven seamed structure comprises a fabric thickness of 2 mm or less.

In another example embodiment, a woven seamed structure is provided. The woven seamed structure is formed by the process of: providing a plurality of threads parallel to a warp axis; providing at least one weaving thread; and weaving the at least one weaving thread into the plurality of threads back and forth in directions parallel to a weft axis, the weft axis being perpendicular to the warp axis. The at least one weaving thread is configured to change between patterns at a first position in a first pick and at a second position in a second pick so as to form a first transition line between the first position and the second position. The first transition line extends at a first non-zero angle from the warp axis. The first transition line is not parallel to the weft axis. The at least one weaving thread is further configured to change between patterns at a third position in a third pick and at a fourth position in a fourth pick so as to form a second transition line between the third position and the fourth position. The second transition line extends at a second non-zero angle from the warp axis. The second transition line is not parallel to the weft axis. The first transition line and the second transition line form at least a portion of a woven seamed structure therebetween, wherein the woven seamed structure defines a central axis that, when extending between the first transition line and the second transition line, extends along a third non-zero angle from the warp axis that is not parallel to the weft axis.

In some embodiments, the at least one weaving thread is further configured to change between a first pattern and a second pattern at the first position in the first pick and at the second position in the second pick so as to form the first transition line, wherein the at least one weaving thread is further configured to change between a third pattern and a fourth pattern at the third position in the third pick and at the fourth position in the fourth pick so as to form the second transition line. In some embodiments, the first pattern and the second pattern are the same. In some embodiments, the first pattern and the second pattern are different. In some embodiments, the second pattern and the fourth pattern are the same. In some embodiments, the second pattern and the fourth pattern are different.

In some embodiments, the woven seamed structure comprises a body including the first transition line and the second transition line, wherein a layer of the woven seamed structure between the first transition line and the second transition line exhibits an increase in stretchability along a length direction of the body of at least 175% compared with an otherwise same second woven seamed structure that was formed with one or more transition lines at a zero angle with respect to the weft axis or the warp axis.

In some embodiments, the woven seamed structure comprises a body including the first transition line and the second transition line, wherein a layer of the woven seamed structure between the first transition line and the second transition line exhibits an increase in elongation along a length direction of the body of at least 20%.

In some embodiments, the woven seamed structure comprises a body including the first transition line and the second transition line, wherein the woven seamed structure is formed of yarn comprising 8-80 denier per yarn, wherein a layer of the woven seamed structure between the first transition line and the second transition line exhibits an increase in elongation along a length direction of the body of at least 200% compared to a second woven seamed structure with transition lines formed at a zero angle with respect to the weft axis or the warp axis, and wherein the second woven seamed structure otherwise comprises the same properties of denier per yarn as the woven seamed structure.

In some embodiments, the woven seamed structure is formed of yarn comprising 200 denier or less. In some embodiments, the woven seamed structure comprises a body including the first transition line and the second transition line, wherein the body of the woven seamed structure comprises a fabric thickness of 2 mm or less.

In another example embodiment, a system for weaving a woven seamed structure is provided. The system comprises a plurality of threads extending parallel to a warp axis; at least one weaving thread; and a mechanical weaver. The mechanical weaver is configured to: weave the at least one weaving thread into the plurality of threads back and forth in directions parallel to a weft axis, the weft axis being perpendicular to the warp axis; in a machine direction, change the at least one weaving thread between patterns at a first position in a first pick and at a second position in a second pick so as to form a first transition line between the first position and the second position, wherein the first transition line extends at a first non-zero angle from the warp axis, wherein the first transition line is not parallel to the weft axis; and change between patterns at a third position in a third pick and at a fourth position in a fourth pick so as to form a second transition line between the third position and the fourth position, wherein the second transition line extends at a second non-zero angle from the warp axis, and wherein the second transition line is not parallel to the weft axis. The first transition line and the second transition line form at least a portion of a woven seamed structure therebetween. The woven seamed structure defines a central axis that, when extending between the first transition line and the second transition line, extends along a third non-zero angle from the warp axis that is not parallel to the weft axis.

In another example embodiment, a method for forming a multi-layered structure is provided. The method comprises providing a plurality of threads parallel to a warp axis; providing at least one weaving thread; and weaving the at least one weaving thread into the plurality of threads back and forth in directions parallel to a weft axis, the weft axis being perpendicular to the warp axis. The at least one weaving thread is configured to change between patterns at a first position in a first pick and at a second position in a second pick. The first position and the second position are at first different locations along the weft axis. The at least one weaving thread is further configured to change patterns at a third position in a third pick and at a fourth position in a fourth pick. The third position and the fourth position are at second different locations along the weft axis.

In another example embodiment, a woven seamed structure is provided. The woven seamed structure comprises a plurality of threads extending parallel to each other in a first direction; at least one weaving thread woven into the plurality of threads back and forth in a second direction perpendicular to the first direction; a first transition line extending at a first non-zero angle from the first direction, wherein the first transition line is not parallel to the second direction, the first transition line being formed by a first change in pattern during weaving of the at least one weaving thread, wherein the first transition line extends along an edge of the woven seamed structure; a second transition line extending at a second non-zero angle from the first direction, wherein the second transition line is not parallel to the second direction, the second transition line being formed by a second change in pattern during weaving of the at least one weaving thread, wherein the second transition line extends along the edge of the woven seamed structure; and a body formed from the plurality of threads and the at least one weaving thread, wherein the body includes the first transition line and the second transition line.

In some embodiments, the body defines a central axis that extends along a third non-zero angle from the first direction. In some embodiments, the first non-zero angle, the second non-zero angle, and the third non-zero angle are the same. In some embodiments, the first non-zero angle, the second non-zero angle, and the third non-zero angle are different.

In some embodiments, the body defines a tubular shape.

In some embodiments, the body defines a plurality of chambers or conduits.

In some embodiments, the plurality of threads are woven together at one or more points between the first transition line and the second transition line.

In some embodiments, the woven seamed structure has a first opening at a first end and a second opening at a second end, wherein the first transition line extends between the first end and the second end, wherein the second transition line extends between the first end and the second end.

In some embodiments, the woven seamed structure has a first opening at a first end and is closed at a second end, wherein the first transition line extends between the first end and the second end, wherein the second transition line extends between the first end and the second end.

In some embodiments, the woven seamed structure is closed at a first end and is closed at a second end, wherein the first transition line extends between the first end and the second end, wherein the second transition line extends between the first end and the second end.

In some embodiments, the first transition line forms a first seam and the second transition line forms a second seam.

In some embodiments, the woven seamed structure has a first opening at a first end and a second opening at a second end. In some embodiments, the first transition line is straight from the first end to the second end, and wherein the second transition line is straight from the first end to the second end.

In some embodiments, the first non-zero angle is an angle ranging from 30 degrees to 75 degrees.

In some embodiments, the first non-zero angle is an angle ranging from 40 degrees to 50 degrees.

In some embodiments, the plurality of threads and the at least one weaving thread are comprised of a same material. In some embodiments, the same material is an elastic material.

In some embodiments, the plurality of threads is comprised of a first material, and wherein the at least one weaving thread is comprised of a second material. In some embodiments, the first material has a first modulus of elasticity, and wherein the second material has a second modulus of elasticity that is different than the first modulus of elasticity.

In some embodiments, a layer of the woven seamed structure between the first transition line and the second transition line exhibits an increase in stretchability along a length direction of the body of at least 175% compared with an otherwise same second woven seamed structure that was formed with one or more transition lines at a zero angle with respect to the first direction or the second direction.

In some embodiments, a layer of the woven seamed structure between the first transition line and the second transition line exhibits an increase in elongation along a length direction of the body of at least 20%.

In some embodiments, the woven seamed structure is formed of yarn comprising 8-80 denier per yarn, wherein a layer of the woven seamed structure between the first transition line and the second transition line exhibits an increase in elongation along a length direction of the body of at least 200% compared to a second woven seamed structure with transition lines formed at a zero angle with respect to the first direction or the second direction, and wherein the second woven seamed structure otherwise comprises the same properties of denier per yarn as the woven seamed structure.

In some embodiments, the woven seamed structure is formed of yarn comprising 200 denier or less. In some embodiments, the body of the woven seamed structure comprises a fabric thickness of 2 mm or less.

In another example embodiment, a woven seamed structure is provided. The woven seamed structure comprises a body comprising: a plurality of threads extending parallel to each other in a first direction; at least one weaving thread woven into the plurality of threads back and forth in a second direction perpendicular to the first direction; and one or more seams formed at a first non-zero angle from the first direction and the second direction, wherein the one or more seams extends along an edge of the body. A layer of the woven seamed structure exhibits an increase in stretchability along a length direction of the body of at least 175% compared with an otherwise same second woven seamed structure with one or more second seams that were formed at a zero angle with respect to the first direction or the second direction.

In some embodiments, the layer of the woven seamed structure exhibits an increase in elongation along a length direction of the body of at least 20%.

In some embodiments, the woven seamed structure is formed of yarn comprising 8-80 denier per yarn, wherein the layer of the woven seamed structure exhibits an increase in elongation along a length direction of the body of at least 200% compared to the otherwise same second woven seamed structure, and wherein the otherwise same second woven seamed structure otherwise comprises the same properties of denier per yarn as the woven seamed structure.

In some embodiments, the woven seamed structure is formed of yarn comprising 200 denier or less. In some embodiments, the body of the woven seamed structure comprises a fabric thickness of 2 mm or less.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 18:
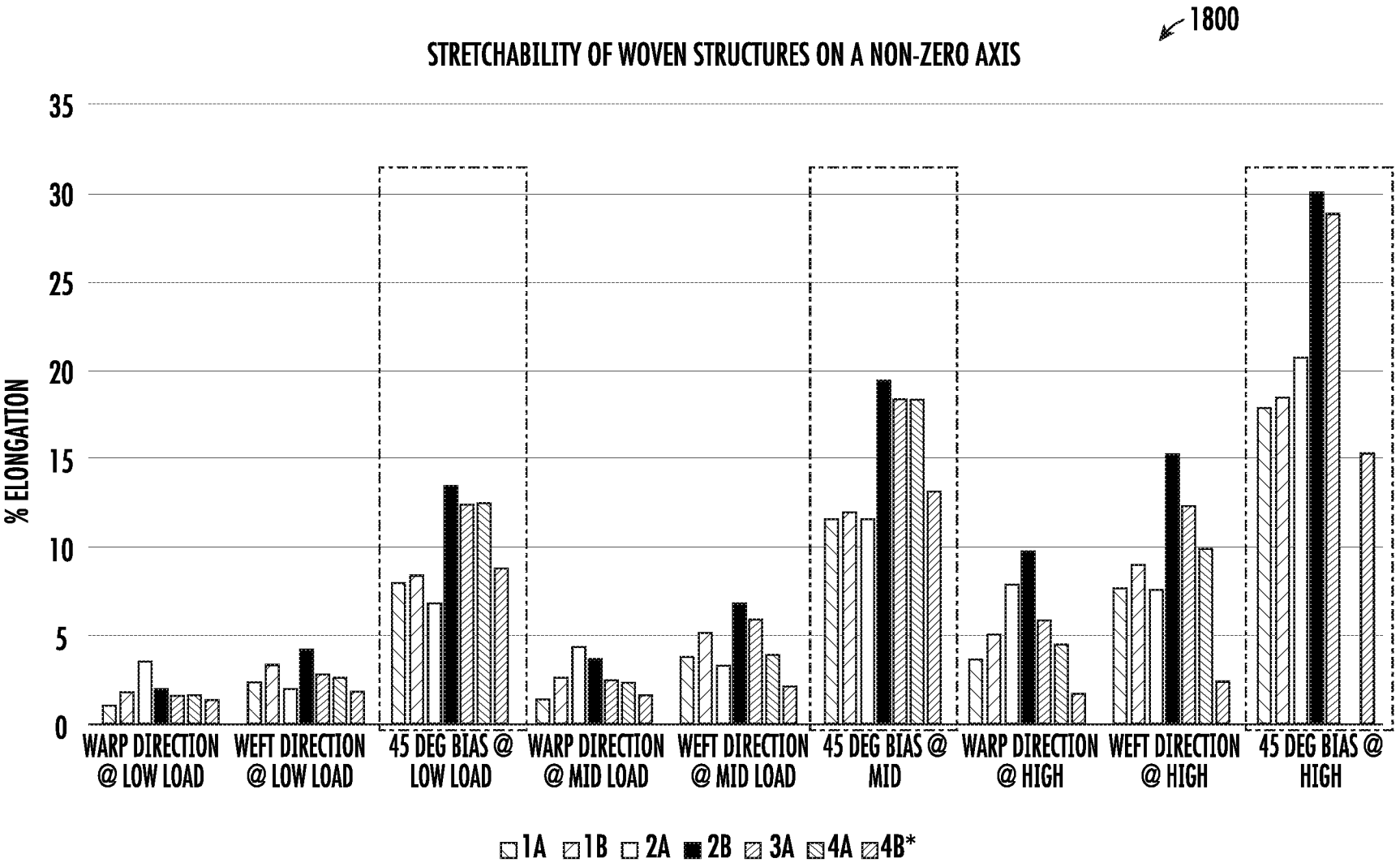
Figure 19:
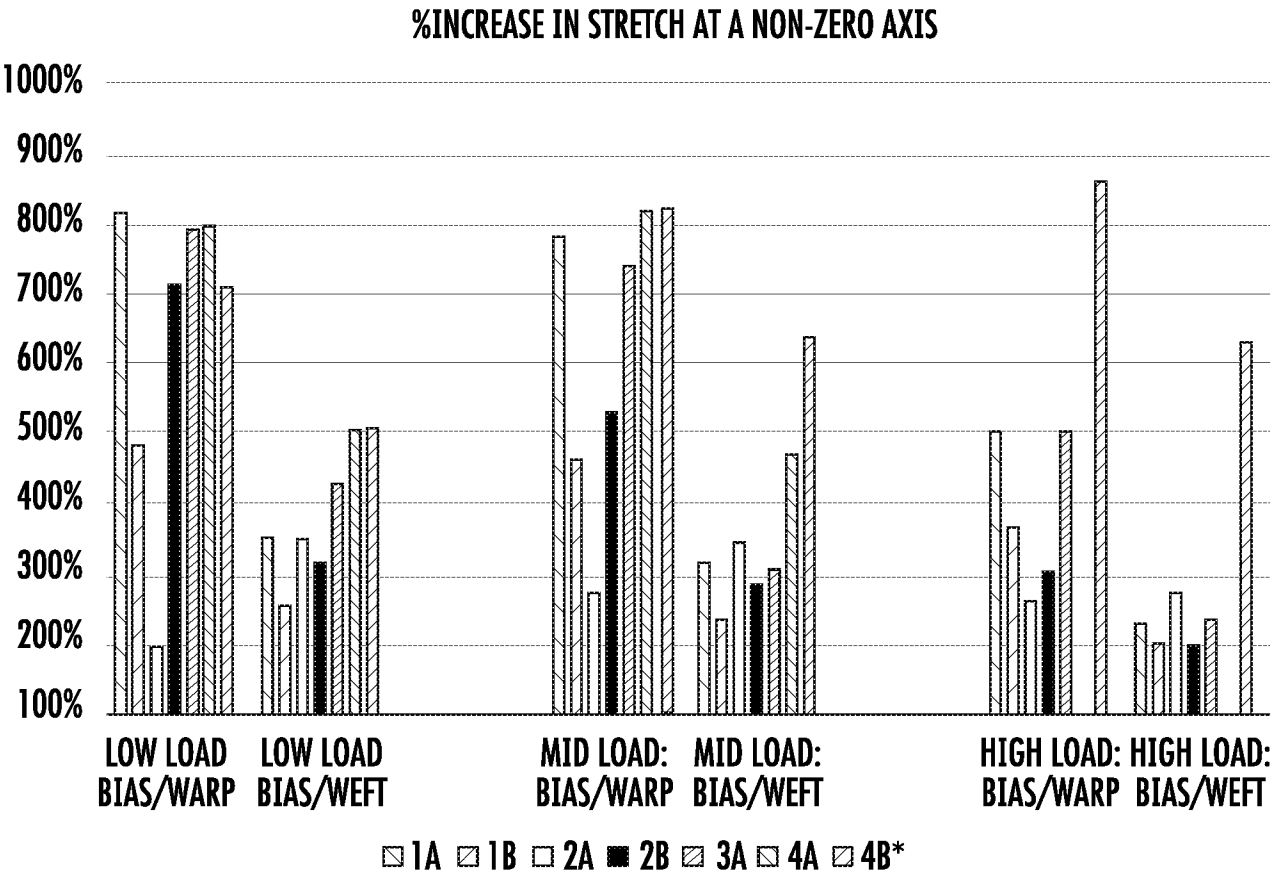

FIG. 18 provides a chart that illustrates the stretchability of woven structures, comparing a layer of a traditional woven structure woven with transition lines at a zero-degree angle with respect to the warp axis; a layer of a traditional woven structure woven with transition lines at a zero-degree angle with respect to the weft axis; and a layer of a woven structure woven with transition lines at a 45 degree angle, such as contemplated herein; and FIG. 19 provides a chart that illustrates the percentage increase in stretchability of woven structures, comparing a layer of a traditional woven structure woven with transition lines at a zero-degree angle with respect to the warp axis; a layer of a traditional woven structure woven with transition lines at a zero-degree angle with respect to the weft axis; and a layer of a woven structure woven with transition lines at a 45 degree angle, such as contemplated herein.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout.

Woven seamed structures are used for various purposes, such as for implantation into a body. In this regard, such seamed structures may form one or more conduits, openings, or chambers for holding or enabling passage of fluid, such as blood or other bodily fluids. For example, some woven seamed structures may be used as vascular grafts, valve skirts, or other conduits for implantation into a body.

When such grafts are implanted, however, the length of the graft is critically important. Particularly, the graft needs to be sized so that when the implantation is complete, the graft acts as an organic blood vessel would act in allowing blood to freely flow therethrough. However, the graft can't be too long such that it may affect nearby tissue, organs, blood vessels, or other medical devices (e.g., additional implanted grafts). Along similar lines, if a graft is too long, it may be prone to kinking. On the opposite end, if the graft is too small, it may cause unnecessary stress on body tissue, etc. as it stretches to and/or it may be more prone to rupture.

When example seamed structures are woven, a weaving thread is woven in a desired pattern into a plurality of threads that are stretched parallel to a warp axis. Traditionally, when this is done, the weaving thread is continuously woven back and forth in directions parallel to a weft axis such that the woven seamed structure is formed. Depending on the weaving design, one or more seams are formed to define a body therebetween, with the body having a central axis that is parallel to the warp axis or parallel to the weft axis. Seamed structures woven in this manner have a limited degree of stretchability or compliance, but the stretchability is not high enough for certain applications.

Figure 1A:
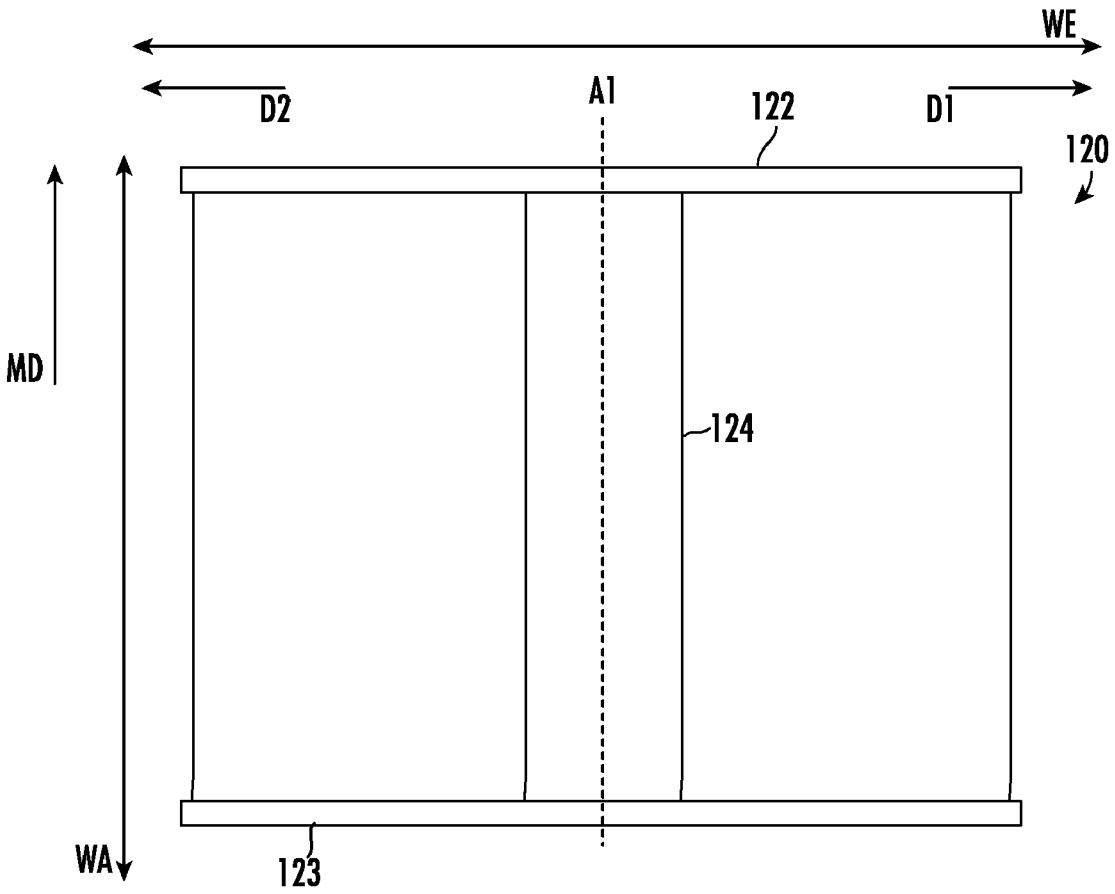
FIG. 1A illustrates an example woven seamed structure on a weaving machine, the woven seamed structure oriented at a zero-degree angle from a warp axis.

FIG. 1A illustrates such an example woven seamed structure 124 on a weaving machine 120. The weaving machine 120 has a let off shaft 122 and a take up shaft 123, which extends parallel to a weft axis (indicated by the double arrow WE). The weaving machine has a plurality of threads (not shown) extending parallel to a warp axis (indicated by the double arrow WA) between the shafts 122 and 123, and it is configured to weave a weaving thread back and forth in a pattern across the plurality of threads to form the woven seamed structure 124. The weaving thread is configured to be woven in a first direction (arrow D1) that is parallel to the weft axis WE and then in a second direction (arrow D2), or vice versa, which is also parallel to the weft axis WE. When the weaving thread changes from traveling in the first direction to traveling in the second direction, it moves in a machine direction (arrow MD). The machine direction extends from the take up shaft 123 to the let off shaft 122 and is parallel to the warp axis WA. The warp axis WA is perpendicular to the weft axis WE.

Figure 1B:
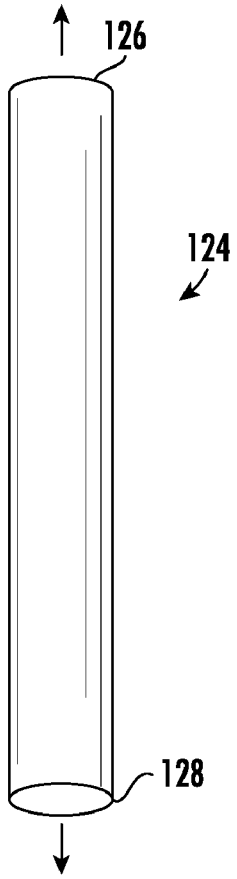
FIG. 1B illustrates the woven seamed structure of FIG. 1A that has been removed from the weaving machine.

In the embodiment shown, the weaving thread is woven directly back and forth in the first direction and the second direction, progressively in the machine direction, such that the woven seamed structure 124 is formed. Because a pattern change occurs at a same location along the weft axis WE as the woven seamed structure is woven in the machine direction, a central axis A1 of the resulting woven seamed structure is zero degrees with respect to the warp axis WA. With reference to FIG. 1B, the woven seamed structure 124 has a first end 126 and a second end 128. FIG. 1B illustrates the woven seamed structure 124 removed from the weaving machine 120 and pulled into a stretched state (as indicated by both arrows). A user may, for example, grab the first end 126 of the woven seamed structure 124 and the second end 128 of the woven seamed structure 124 and pull the first end 126 and the second end 128 apart to move the woven seamed structure 124 from a relaxed state to the stretched state shown in FIG. 2B.

As noted above, providing for desired stretchability and compliance is important to aid in implantation, deal with the particularities of the body it is being implanted into, adjust for tolerances, and/or to act more like the native blood vessel in which it is implanted. Accordingly, example embodiments of the present invention include a seamed structure that is woven such that it has transition lines and/or a central axis that forms a non-zero angle with a warp axis on a weaving machine. Seamed structures woven in this are more stretchable in their longitudinal and circumferential directions. For example, the woven seamed structure is formed by weaving a weaving thread into a plurality of threads such that certain ones of the plurality of threads are woven differently by the weaving thread relative to the weft axis. This forms transition lines that have non-zero angles with the warp axis, which can be designed as a seam to form a woven seamed structure on the weaving machine. The woven seamed structure accordingly forms a body that can act as a conduit or chamber depending on the configuration and designed use.

Figure 2:
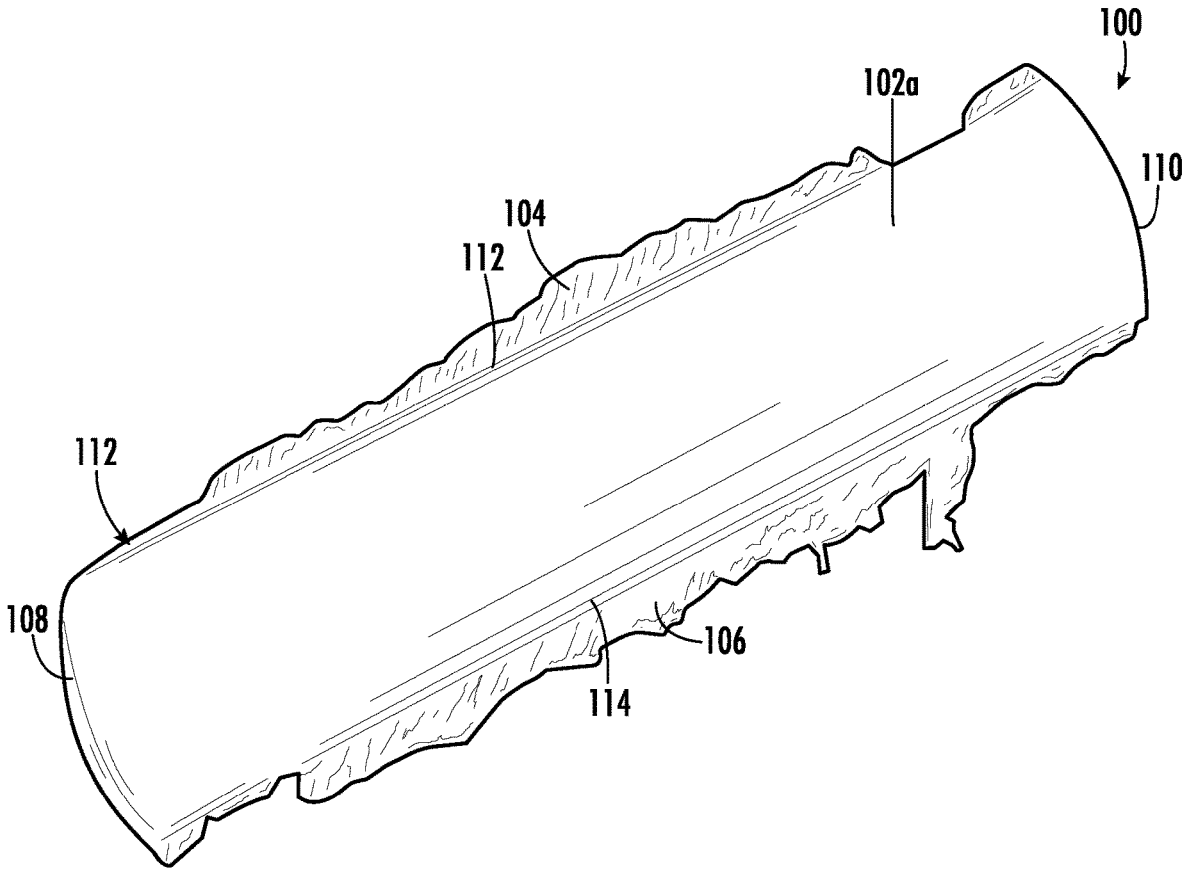
FIG. 2 illustrates an example woven seamed structure, in accordance with some embodiments discussed herein.

FIG. 2 illustrates an example woven seamed structure assembly 100. The woven seamed structure assembly 100 includes a woven seamed structure 102 with a first transition line 112 and a second transition line 114 extending between a first opening at a first end 108 and a second opening at a second end 110. In the embodiment shown, the woven seamed structure assembly 100 has been removed from a weaving machine with thread edges 104 and 106 still attached to transition lines 112 and 114. As shown by the angle of the transition lines 112, 114 and a body 102*a* of the woven seamed structure 102 with respect to the thread edges 104 and 106, and as will be described in more detail herein, the woven seamed structure 102 is woven on the weaving machine at an angle (e.g., a non-zero angle with respect to a warp axis and the weft axis—or said differently, not parallel to either the warp axis or the weft axis) such that the woven seamed structure has a higher stretchability in a longitudinal direction (e.g., along its central axis) than it would if it had been woven on the weaving machine in typical manner (e.g., at a zero-angle with respect to the warp axis or at a zero-angle with respect to the weft axis). In some embodiments, as described herein, the angled orientation of the woven seamed structure is achieved by gradually or intermittently changing a pattern of a weaving thread as it is woven into a plurality of threads on a weaving machine. The woven seamed structure may be of any consistent or changing diameter. For example, in some embodiments, the diameter of the woven seamed structure may be less than 20 millimeters. In other embodiments, however, the diameter may be any other value (e.g., 100 mm or less, 50 mm or less, 40 mm or less, 2 mm or more, 4 mm or more, 10 mm or more, 2 mm to 20 mm, 4 mm to 40 mm, etc.). Notably, while various embodiments herein describe a "woven seamed structure", a woven seamed structure may be open or closed and any multi-layered structure that may form any shape overall and/or cross-sectionally at one or more sections, such as cones, skirts, tapers, double tapers, plural helices, among other shapes or designs.

Figure 3:
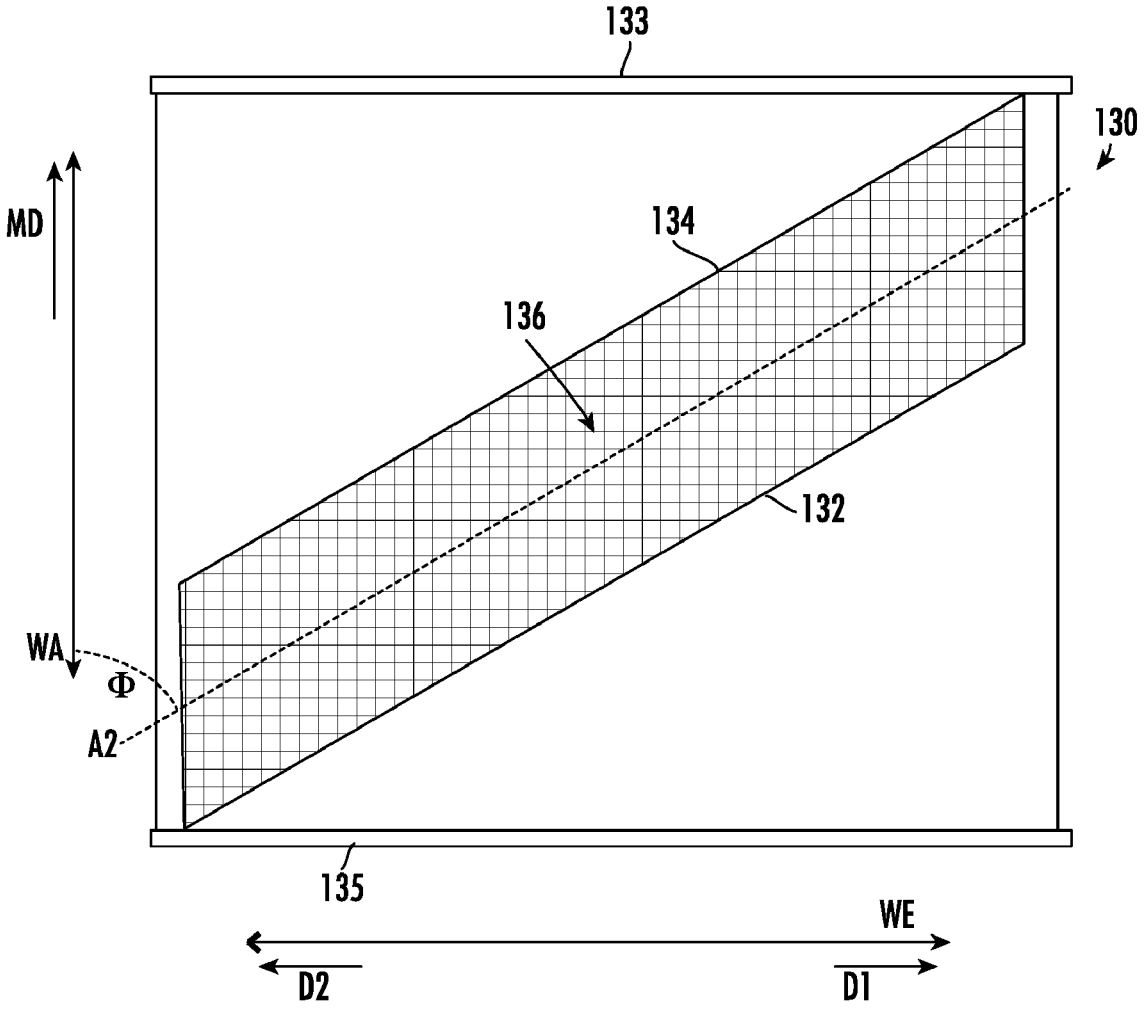
FIG. 3 shows an example woven seamed structure on a weaving machine, the woven seamed structure having a central longitudinal axis oriented at a 45-degree angle from a warp axis, in accordance with some embodiments discussed herein.

FIG. 3 shows a weaving machine 130 with a let off shaft 133 and a take up shaft 135 extending parallel to a weft axis WE. A plurality of threads extend parallel to a warp axis WA between the shafts 133 and 135, and at least one weaving thread is woven back and forth into the plurality of threads in a first direction and a second direction. The first direction and the second direction are both parallel to the weft axis WE. The weaving thread is woven such that, in a machine direction, a pattern is gradually or intermittently changed to form the woven seamed structure 136, which has a central axis A2 that forms a non-zero angle $\phi$ with respect to the warp axis WA. As will be described in more detail herein, the non-zero angle of the woven seamed structure 136 is achieved by gradually or intermittently changing between a first pattern and a second pattern and gradually or intermittently changing between a third pattern and a fourth pattern as the weaving thread is woven into the plurality of threads. Within one pass of the weaving thread in the first direction (e.g., along one pick), for example, the weaving thread may change from a first pattern to a second pattern at a first position along the weft axis WE at the beginning of the pass and then the weaving thread may change from a third pattern to a fourth pattern at a second position along the weft axis WE at the end of the pass (although in some embodiments the change from the first pattern to the second pattern at the first position may occur in a different pick than the change from the third pattern to the fourth pattern). As noted herein, the various patterns may be the same other than between a change forming a transition line. For example, while there is a second pattern and a third pattern, in some embodiments, such patterns may be the same, although they may be different in other embodiments. Similarly, while there is a first pattern and a fourth pattern, in some embodiments, such patterns may be the same, although they may be different in other embodiments.

Figure 6:
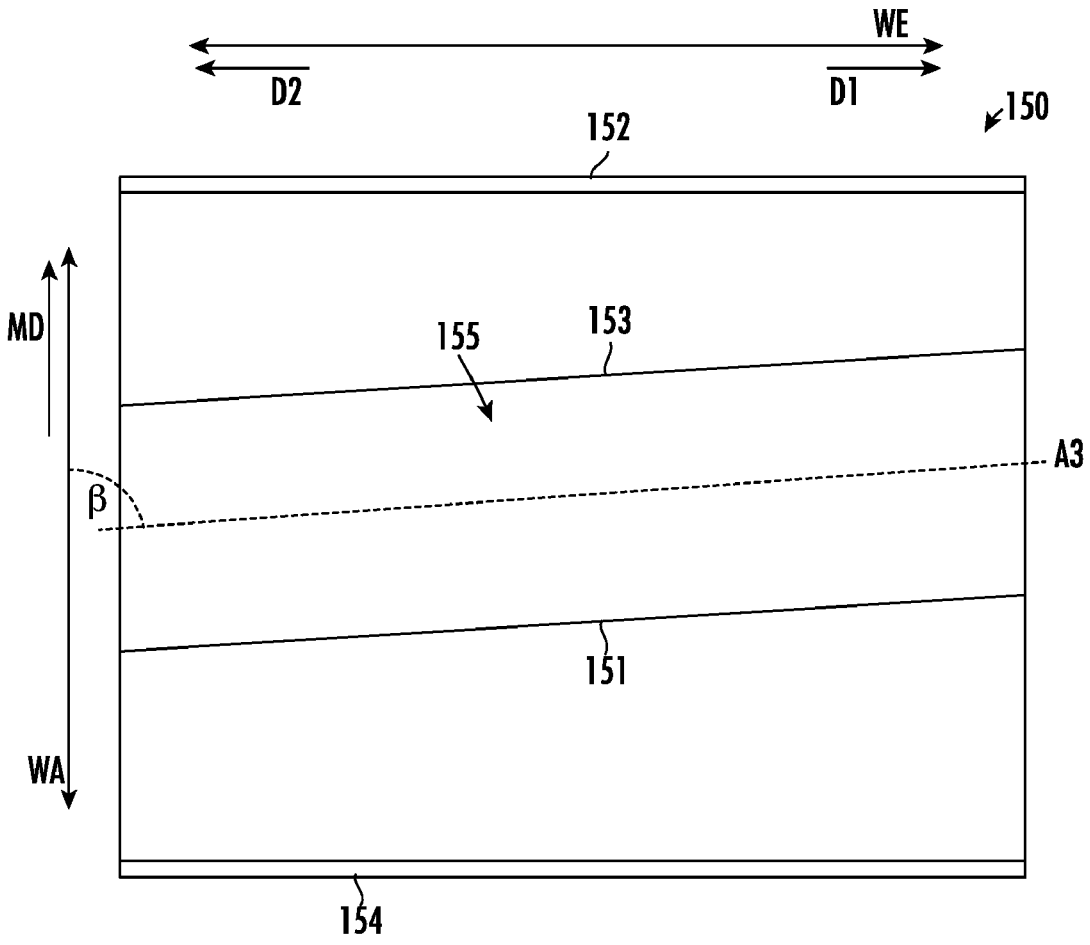
FIG. 6 illustrates an example woven seamed structure on a weaving machine, the woven seamed structure having a central longitudinal axis oriented at an 85-degree angle from a warp axis, in accordance with some embodiments discussed herein.

As the weaving thread progressively weaves back and forth (building in the machine direction), the positions along the weft axis WE in which the pattern changes occur are gradually or intermittently changed. In this regard, the gradual or intermittent changing of the pattern change positions is configured such that two transition lines 134 and 132 form at non-zero angles from the warp axis WA (e.g., the first transition line 134 forms a same non-zero angle $\phi$ with respect to the warp axis WA, and the second transition line 132 also forms a same non-zero angle $\phi$ with respect to the warp axis WA). The result is a woven seamed structure such as the woven seamed structure 136, which has a central axis A2 that has the same non-zero angle $\phi$ from the warp axis WA as does the transition lines 134 and 132. The non-zero angle $\phi$ depicted in FIG. 6 is approximately 45 degrees, but the non-zero angle may be any other non-zero angle with the warp axis WA (e.g., see FIG. 6). For example, the non-zero angle may be between 30 and 75 degrees, between 40 and 50 degrees, between 10 and 80 degrees, between 1 and 89 degrees, etc.

Notably, the woven seamed structure 136 may be configured such that the first transition line 134 forms a first non-zero angle with the warp axis WA and the second transition line 132 forms a second non-zero angle with the warp axis WA. It is also worth noting that the first transition line 134 is also at a non-zero angle with the weft axis WE and, likewise, the second transition line 132 is also at a non-zero angle with the weft axis WE. Said differently, the first transition line 134 and the second transition line 132 are not parallel to either the warp axis WA or the weft axis WE. In some embodiments, the first non-zero angle may be the same as the second non-zero angle, such as shown in FIG. 3. However, in some other embodiments, the first non-zero angle may be different than the second non-zero angle. In embodiments in which the first non-zero angle is different from the second non-zero angle, the central axis 136 of the woven seamed structure forms a third non-zero angle from the warp axis WA that is between the first non-zero angle and the second non-zero angle. Notably, the central axis 136 is also at a non-zero angle with respect to the weft axis WE (or said differently, is not parallel to either the warp axis WA or the weft axis WE). Notably, while one central axis is shown in the embodiment illustrated in FIG. 3, in some configurations more than one central axis may be provided, such as in the case where the body of the woven seamed structure has multiple conduits and/or chambers. In such a situation, one or more of such central axes may be formed at a non-zero angle with respect to the warp axis WA and the weft axis.

Figure 4:
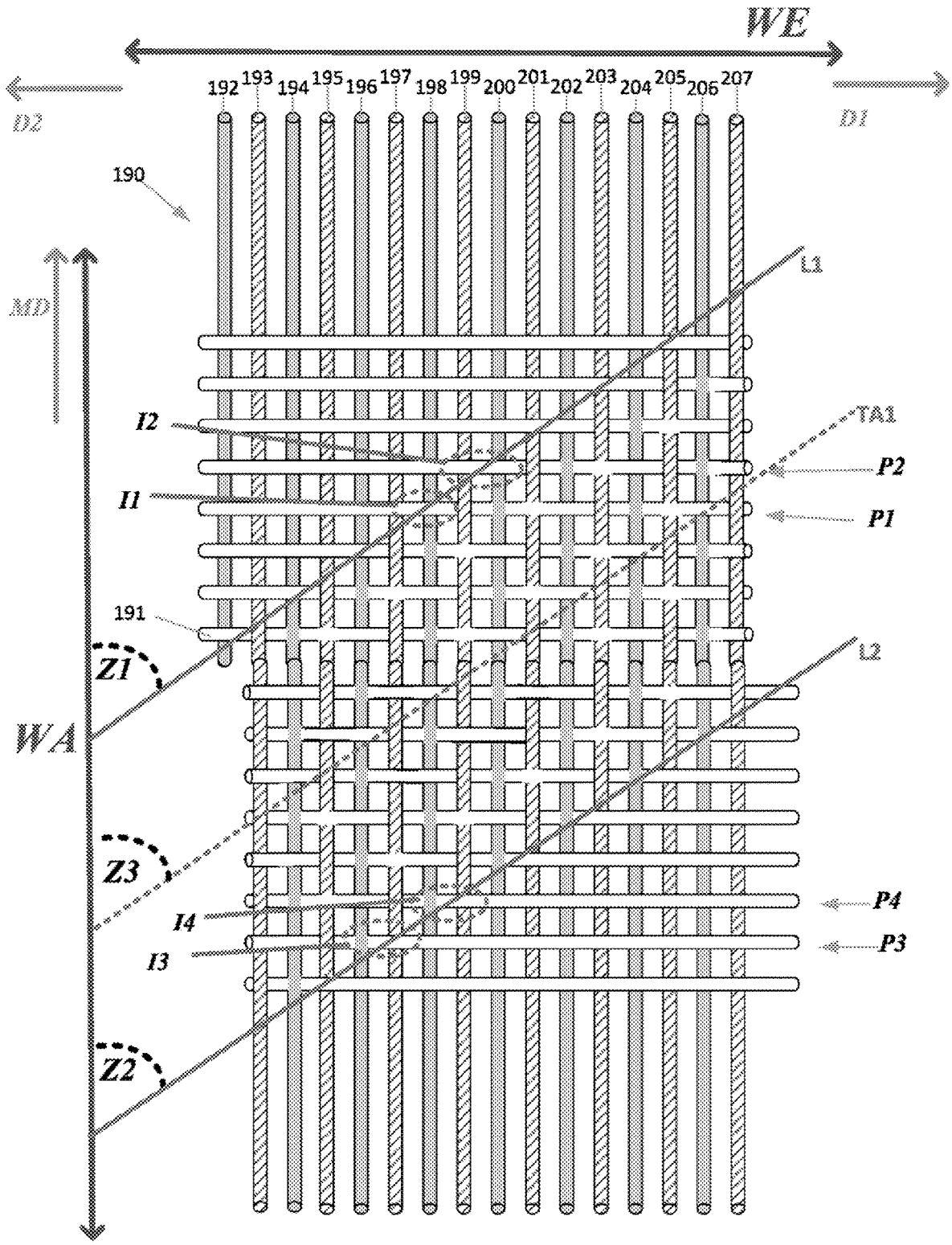
FIG. 4 illustrates a zoomed-in view of a plurality of threads being woven into an example woven seamed structure, in accordance with some example embodiments discussed herein.

FIG. 4 shows a zoomed-in schematic view of a weaving pattern 190, illustrating a weaving thread 191 being woven into a plurality of threads to form a woven seamed structure. The weaving thread 191 is woven back and forth in the first direction D1 and the second direction D2 along a weft axis WE for a plurality of passes, such that the weaving pattern 190 moves in the machine direction MD. The first and second directions D1 and D2 are parallel to the weft axis WE, and the machine direction is parallel to a warp axis WA. In the embodiment shown, the weaving thread 191 is being woven in a way so that, in the machine direction, the pattern is being changed to form transition lines that form non-zero angles with the warp axis WA. Notably, the transition lines may be used to define a woven seamed structure that can be cut or otherwise removed after formation (such as described herein).

The transition lines are illustrated as a first transition line L1 and a second transition line L2 in FIG. 4. To form the first transition line (illustrated by line L1), the weaving thread 191 changes between a first pattern (e.g., fully disengaging threads) and a second pattern (e.g., an over-under weaving pattern) at gradual positions along the weft axis WE as the weaving thread 191 moves back and forth in the machine direction MD (notably, the change could occur in other embodiments in an intermittent or different manner). To form the second transition line (illustrated by line L2), the weaving thread 191 changes between a third pattern (e.g., an over-under weaving pattern) and a fourth pattern (e.g., fully disengaging threads) at gradual positions along the weft axis WE as the weaving thread 191 moves back and forth in the machine direction MD. In the embodiment shown in FIG. 4, the first and fourth patterns consist of the weaving thread 191 simply passing over or disengaging each of the threads, and the second and third patterns are an over-under weaving pattern. In other embodiments, the first, second, third, and fourth patterns may all be different, and other patterns may be used (such as a plain, twill pattern, satin, basket weave, or any other pattern). Notably, more than one thread can be engaged or disengaged at transition points to form a different non-zero angle (with respect to the warp axis WA) for the transition lines. Likewise, variable numbers of threads can be engaged or disengaged at transition points, which may create a different angled transition line. The variable number of threads being engaged or disengaged may be repeatable or non-repeatable depending on the desired transition line to be created. Along similar lines, depending on the embodiment, there may be differences in when the transition points occur between the first transition line L1 and the second transition line L2, such that different angles with respect to the warp axis WA are formed.

Regarding formation of the first transition line L1 in FIG. 4, the weaving thread 191 is changed, in the machine direction, between being woven in a first pattern and being woven in a second pattern. In the embodiment shown in FIG. 4, the first pattern is simply disengagement of the plurality of threads. That is, the weaving thread 191 passes over the plurality of threads as it is being woven according to the first pattern, and then the weaving thread 191 changes to an over-under weaving pattern according to the second pattern at differing points along the weft axis WE (or vice versa). According to the illustrated embodiment, the weaving thread 191 (working to the right along a first pick P1 in FIG. 4) passes over threads 196 and 197 (according to the first pattern) and then changes, at a first weft insertion I1 in the first pick P1, to pass over thread 198 and under thread 199 (according to the second pattern) at a first intersection point with the first transition line L1. On another pass in the machine direction, the weaving thread 191 (now working to the left along a second pick P2 in FIG. 4) weaves over and under threads 202, 201, and 200 (according to the second pattern) and then changes, at a second weft insertion I2 in the second pick P2, to passing over the remaining threads (according to the first pattern) at thread 199 at a second intersection point with the first transition line L1. Accordingly, the first transition line L1 is illustrated, and extends at a first non-zero angle Z1 with respect to the warp axis WA.

Regarding formation of the second transition line L2 in FIG. 4, the weaving thread 191 is changed, in the machine direction, between being woven in a third pattern and being woven in a fourth pattern. In the embodiment shown in FIG. 4, the third pattern is the same as the second pattern, and the fourth pattern is simply disengagement of the plurality of threads (which is the same as the first pattern). That is, the weaving thread 191 is woven in an over-under weaving pattern according to the third pattern, and the weaving thread 191 changes to the fourth pattern (or vice versa) at differing points along the weft axis WE so as to pass over the plurality of threads. According to the illustrated embodiment, the weaving thread 191 (working to the right along a third pick P3 in FIG. 4) passes under thread 195 and over thread 196 (according to the third pattern) and then changes, at a third weft insertion I3 in the third pick P3, to pass over the remaining threads (according to the fourth pattern) at thread 197 at a third intersection point with the second transition line L2. On another pass in the machine direction, the weaving thread 191 (now working to the left along a fourth pick P4 in FIG. 4) weaves over threads 201, 200, and 199 (according to the fourth pattern) and then changes, at a fourth weft insertion I4 in the fourth pick P4, to the third pattern, passing over thread 198 and under thread 197 (and so on) at a fourth intersection point with the second transition line L2. Accordingly, the second transition line L2 is illustrated, and extends at a non-zero angle Z2 with respect to the warp axis WA.

Notably, the change(s) from the first pattern to the second pattern and/or from the third pattern to the fourth pattern can be designed such that variable numbers of threads are involved in the transitions at each pass to, e.g., form different non-zero angles (with respect to the warp axis WA). The variable number of threads being used in the transition(s) between patterns may be repeatable or non-repeatable depending on the desired transition line to be created.

Figure 15A:
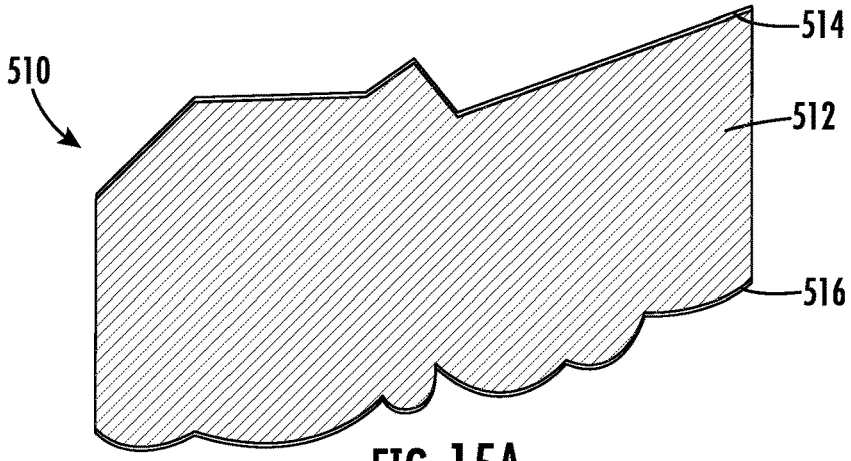
FIG. 15A shows an example woven seamed structure on a weaving machine, the woven seamed structure having irregularly shaped transition lines, in accordance with some embodiments discussed herein.
Figure 15B:
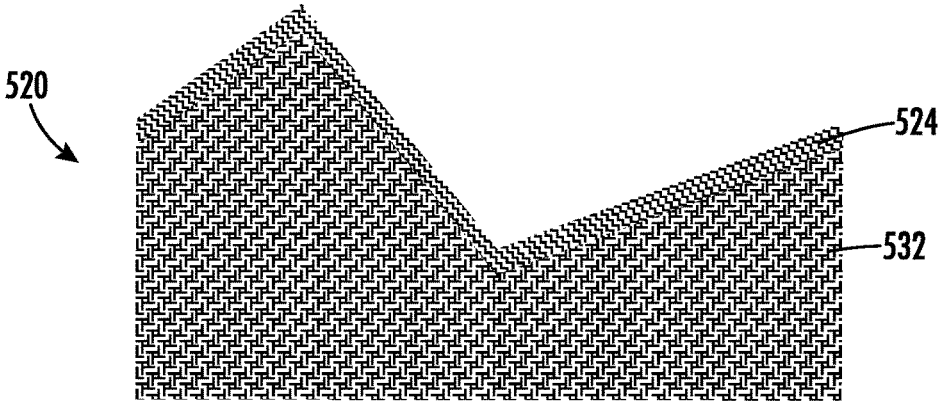
FIG. 15B illustrates a zoomed-in view of an example portion of a woven seamed structure on a weaving machine, the woven seamed structure having an irregularly shaped transition line, in accordance with some embodiments discussed herein.
Figure 15C:
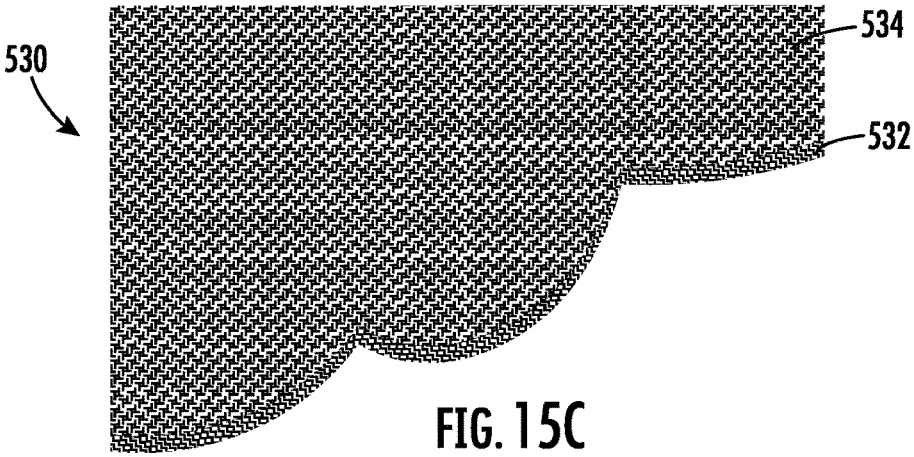
FIG. 15C illustrates a zoomed-in view of an example portion of another woven seamed structure on a weaving machine, the woven seamed structure having an irregularly shaped transition line, in accordance with some embodiments discussed herein.

Notably, in the illustrated embodiment of FIG. 4, the same transition of patterns (e.g., changing the weaving thread 191 from passing over each of the threads to weaving in an over-under pattern) for forming the first transition line is mirrored for formation of the second transition line (e.g., changing the weaving thread 191 from weaving in an over-under pattern to passing over each of the threads). This causes formation of a constant diameter of the resultant woven seamed structure. The resulting woven seamed structure has a central axis with the same non-zero angle with the warp axis WA as the transition lines. For example, with reference to FIG. 4, a woven seamed structure may be formed between the first transition line L1 and the second transition line L2, and the woven seamed structure may have a central axis TAI (e.g., extending between portion of the transition lines noted above) that extends at a third non-zero angle Z3 with respect to the warp axis WA. Such an example embodiment forms a woven seamed structure where the first transition line L1, the second transition line L2, and the central axis TAI all define a same non-zero angle with respect to the warp axis WA (although these angles may differ with respect to each other in other embodiments). While the example weaving pattern 190 of FIG. 4 shows pattern changes that produce a woven seamed structure with a constant diameter and straight transition lines, woven seamed structures with varying diameters and/or irregular shaped transition lines are contemplated, such as illustrated in FIGS. 15A-15C.

Figure 5A:
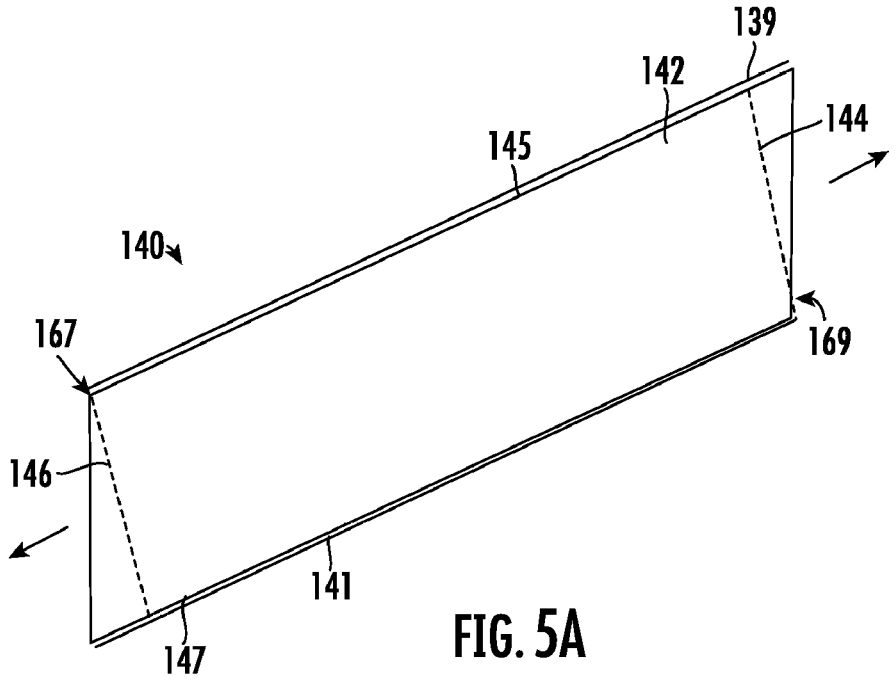
FIG. 5A illustrates an example woven seamed structure that has been removed from a weaving machine, with example cut marks, with arrows showing forces in a longitudinal direction, in accordance with some embodiments discussed herein.

FIG. 5A shows a woven seamed structure 140 that has been removed (e.g., cut) from a weaving machine. For example, the woven seamed structure shown in FIG. 5A has been cut from the weaving machine at cut marks 139 and 141. Because of the non-zero angle at which the woven seamed structure 140 was woven (e.g., on the bias), as shown and described with respect to the woven seamed structure 136 in FIG. 3 above, the woven seamed structure 140 has a higher stretchability than it would have if it were to have been woven at a zero-degree angle with respect to the warp axis. The woven seamed structure 140 may be further cut at cut marks 167 and 169 (e.g., parallel cut marks) to form a first end 146 and second end 144—thereby defining (along with the first side 145 and the second side 147) a body 142. In this regard, the first side 145 and the second side 147 may each include the transition lines described above, such as may have been formed into seams.

Figure 5B:
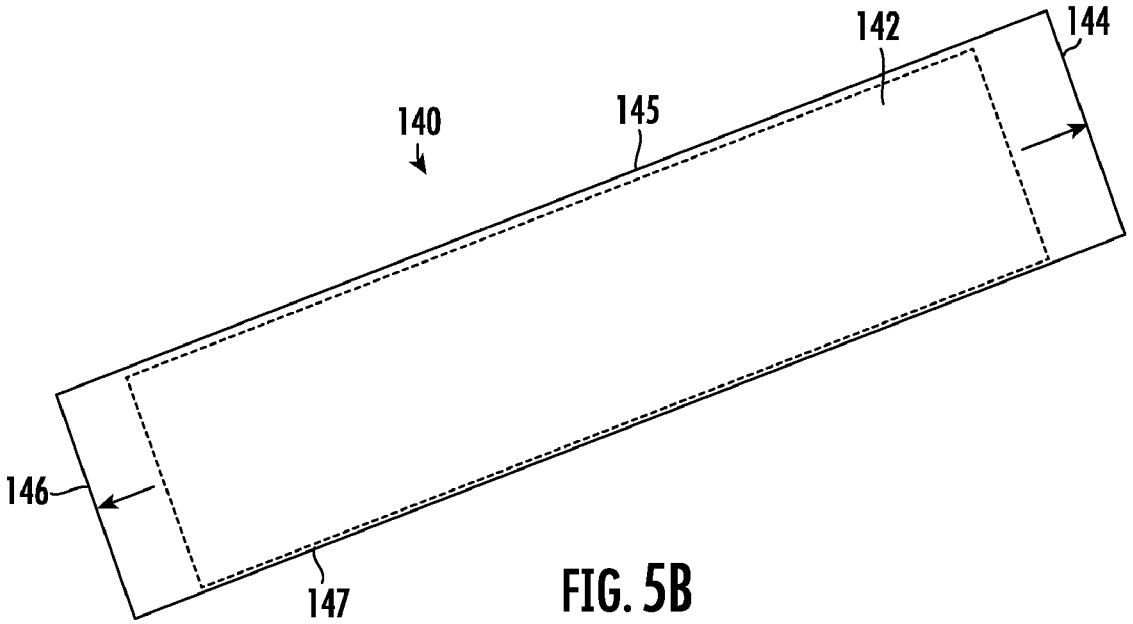
FIG. 5B illustrates the example woven seamed structure of FIG. 5A in a stretched state according to the arrows shown in FIG. 5A, in accordance with some embodiments discussed herein.

When the ends 146 and 144 are pulled apart in a longitudinal direction, the woven seamed structure 140 is stretchable to a position with a longer length, as shown in FIG. 5B. The difference in length exhibited by the woven seamed structure 140, which was woven at a non-zero angle, is higher than the difference in length exhibited by a seamed structure woven at a zero angle, as shown in FIGS. 1A-1B. In some embodiments, the change in length from the shorter length to the longer length in FIGS. 5A-5B may be at least 3.5%. Further, in some embodiments, the change in length from the shorter length to the longer length may be at least 5%; at least 7%; at least 10%; at least 15%; at least 20%; at least 25%; or even at least 30%. In other embodiments, the change in length from the shorter length to the longer length may be any other value.

Notably, FIG. 18 provides a chart 1800 that illustrates the stretchability of woven structures, comparing a layer of a traditional woven structure woven with transition lines at a zero-degree angle with respect to the warp axis; a layer of a traditional woven structure woven with transition lines at a zero-degree angle with respect to the weft axis; and a layer of a woven structure woven with transition lines at a 45 degree angle, such as contemplated herein. The chart 1800 shows a percentage elongation for 7 different example layers from woven structures 1A, 1B, 2A, 2B, 3A, 3B, 4A, 4B. In this regard, the testing was performed on a layer of the woven structure without the seams attached (e.g., a formed woven structure (or a portion of a formed woven structure with the corresponding angled transition lines/center axes) could be cut in half without the seams and that resultant fabric layer would be tested to correspond with the following testing numbers). TABLE 1 (below) shows the various properties of each tested example woven structure. Notably, such testing, as illustrated herein, that woven structures with properties ranging from 8-80 denier per yarn, 0.058 mm-0.230 mm fabric thickness, and 0.480-0.700 grams/cm$^3$ fabric density; and woven at a non-zero angle, such as at a 45 degree angle, show significant increases in stretchability along their length axis.

TABLE 1

| Sample ID | Weave Pattern | Yarn Denier | Fabric Thickness (mm) | Fabric Density (grams/cm3) |
|---|---|---|---|---|
| 1A | Velour | 80 | 0.180 | 0.570 |
| 1B | Velour | 80 | 0.230 | 0.480 |
| 2A | Plain | 40 | 0.120 | 0.650 |
| 2B | Plain | 18 | 0.059 | 0.620 |
| 3A | Plain | 20 | 0.065 | 0.700 |
| 4A | Twill | 20 | 0.079 | 0.530 |
| 4B* | Twill | 9 | 0.058 | 0.488 |

As illustrated in FIG. 18, the traditional woven structure layers that were woven with transition lines at a zero degree angle with respect to the warp axis 1A-4B were stretched along their length axis at different loads (low, mid, and high). Notably, the loads applied where ~2.5 lbf at low loading, ~5 lbf at mid loading, and ~10 lbf at high loading (with the caveat that for sample ID 4B, the low loading was 0.337 lbf (1.5 N), the mid loading was 0.674 lbf (3 N), and the high loading was 1.124 lbf (5 N)—with the reduced relative force being due to an issue with slipping occurring). With reference to TABLE 2A and as shown, the percentage elongation ranged from ~1%-3.5% at a low loading, ~2%-4.25% at mid loading, and ~6.8%-13.5% at high loading. Similarly, the traditional woven structures layers that were woven with transition lines at a zero degree angle with respect to the weft axis 1A-4B were stretched along their length axis at different loads (low, mid, and high). With reference to TABLE 2B and as shown, the percentage elongation ranged from ~1.8%-4.25% at a low loading, ~2%-6.8% at mid loading, and ~2.4%-15.25% at high loading. In comparison, the woven structures layers that were woven with transition lines at a 45 degree angle 1A-4B were stretched along their length axis at different loads (low, mid, and high). With reference to TABLE 2C and as shown, the percentage elongation ranged from ~6.8%-13.5% at a low loading, ~11.6%-19.4% at mid loading, and ~15.3%-30% at high loading. Accordingly, it is shown that forming the woven structure with transition lines at a 45 degree angle can result in increases in percentage of elongation along the length axis ranging from an additional ~3.5%-12% at low loading; ranging from an additional ~7%-15.8% at mid loading; and ranging from ~10%-23% at high loading. Such results provide significant benefit to conformability and stretchability for various medical applications, such as described herein.

TABLE 2A

| | % Elongation @ 2.5 lbs of Force | | |
|---|---|---|---|
| Sample ID | Warp axis @ Low load | Weft axis @ low load | 45 Deg Bias @ low load |
| 1A | 0.962 | 2.223 | 7.896 |
| 1B | 1.727 | 3.313 | 8.404 |
| 2A | 3.484 | 1.960 | 6.790 |
| 2B | 1.888 | 4.251 | 13.484 |
| 3A | 1.567 | 2.891 | 12.384 |
| 4A | 1.566 | 2.474 | 12.548 |
| 4B* | 1.253 | 1.739 | 8.864 |

TABLE 2B

| Sample ID | % Elongation @ 5 lbs Warp axis @ Mid Load | Weft axis @ Mid | 45 Deg Bias @ Mid |
|---|---|---|---|
| 1A | 1.485 | 3.662 | 11.621 |
| 1B | 2.562 | 5.007 | 11.960 |
| 2A | 4.331 | 3.314 | 11.614 |
| 2B | 3.665 | 6.791 | 19.411 |
| 3A | 2.469 | 5.854 | 18.310 |
| 4A | 2.214 | 3.914 | 18.305 |
| 4B* | 1.614 | 2.072 | 13.265 |

TABLE 2C

| Sample ID | % Elongation @ 10 lbs Warp axis @ High | Weft axis @ High | 45 Deg Bias @ High |
|---|---|---|---|
| 1A | 3.564 | 7.558 | 17.887 |
| 1B | 4.933 | 8.987 | 18.311 |
| 2A | 7.738 | 7.463 | 20.589 |
| 2B | 9.762 | 15.257 | 30.080 |
| 3A | 5.771 | 12.289 | 28.808 |
| 4A | 4.415 | 9.840 | N/A* |
| 4B* | 1.770 | 2.411 | 15.296 |

*Sample 4A could not withstand the high load and slipped from the test fixture, resulting in no data.

FIG. 19 provides a chart 1900 that illustrates the percentage increase in stretchability of woven structures, comparing traditional woven structures layers woven with transition lines at a zero-degree angle with respect to the warp axis; traditional woven structures layers woven with transition lines at a zero-degree angle with respect to the weft axis; and woven structures layers woven with transition lines at a 45 degree angle, such as contemplated herein. The chart 1900 shows a percentage increase in stretchability for the same 7 different example woven structures 1A, 1B, 2A, 2B, 3A, 3B, 4A, 4B shown in TABLE 1 (above).

As illustrated in FIG. 19, the traditional woven structures layers that were woven with transition lines at a zero degree angle with respect to the warp axis 1A-4B were stretched along their length axis at different loads (low, mid, and high). This was compared with the woven structures layers that were woven with transition lines at a 45 degree angle 1A-4B, which were also stretched along their length axis at different loads (low, mid, and high). As shown the percentage increase in stretchability of the woven structures layers that were woven with transition lines at a 45 degree angle relative to the woven structures layers that were woven with transition lines at a zero degree angle with respect to the warp axis ranged from ~200%-820% increase at low loading, ~240%-825% increase at mid loading, and ~200%-864% increase at high loading. TABLE 3A provides these results for the low loading; TABLE 3B provides these results for the mid loading; and TABLE 3C provides these results for the high loading.

TABLE 3A

| Sample ID | Low Load Bias/Warp Bias/Warp | Low Load Bias/Weft Bias/Weft |
|---|---|---|
| 1A | 821% | 355% |
| 1B | 487% | 254% |
| 2A | 195% | 346% |

TABLE 3A-continued

| Sample ID | Low Load Bias/Warp Bias/Warp | Low Load Bias/Weft Bias/Weft |
|---|---|---|
| 2B | 714% | 317% |
| 3A | 790% | 428% |
| 4A | 801% | 507% |
| 4B* | 707% | 510% |

TABLE 3B

| Sample ID | Mid Load: Bias/Warp Bias/Warp | Mid Load: Bias/Weft Bias/Weft |
|---|---|---|
| 1A | 783% | 317% |
| 1B | 467% | 239% |
| 2A | 268% | 350% |
| 2B | 530% | 286% |
| 3A | 742% | 313% |
| 4A | 827% | 468% |
| 4B* | 822% | 640% |

TABLE 3C

| Sample ID | High Load: Bias/Warp Bias/Warp | High Load: Bias/Weft Bias/Weft |
|---|---|---|
| 1A | 502% | 237% |
| 1B | 371% | 204% |
| 2A | 266% | 276% |
| 2B | 308% | 197% |
| 3A | 499% | 234% |
| 4A | N/A | N/A* |
| 4B* | 864% | 634% |

*Sample 4A could not withstand the high load and slipped from the test fixture, resulting in no data.

Similarly, the traditional woven structures layers that were woven with transition lines at a zero degree angle with respect to the weft axis 1A-4B were stretched along their length axis at different loads (low, mid, and high). This was compared with the woven structures layers that were woven with transition lines at a 45 degree angle 1A-4B, which were also stretched along their length axis at different loads (low, mid, and high). As shown the percentage increase in stretchability of the woven structures layers that were woven with transition lines at a 45 degree angle relative to the woven structures layers that were woven with transition lines at a zero degree angle with respect to the weft axis ranged from 225%-650% increase at low loading, 200%-600% increase at mid loading, and 175%-350% increase at high loading.

Figure 5C:
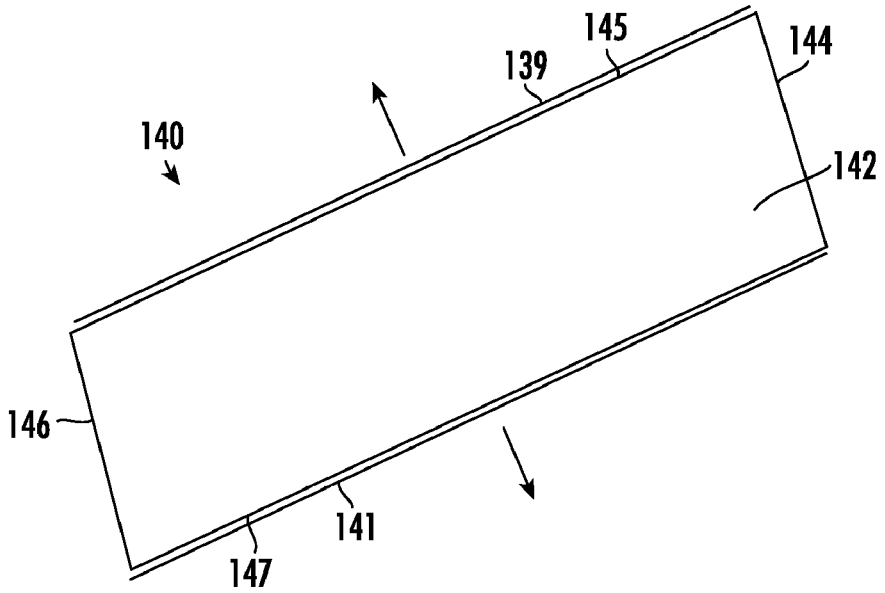
FIG. 5C illustrates the example woven seamed structure of FIG. 5A-5B with arrows showing forces in a circumferential direction, in accordance with some embodiments discussed herein.
Figure 5D:
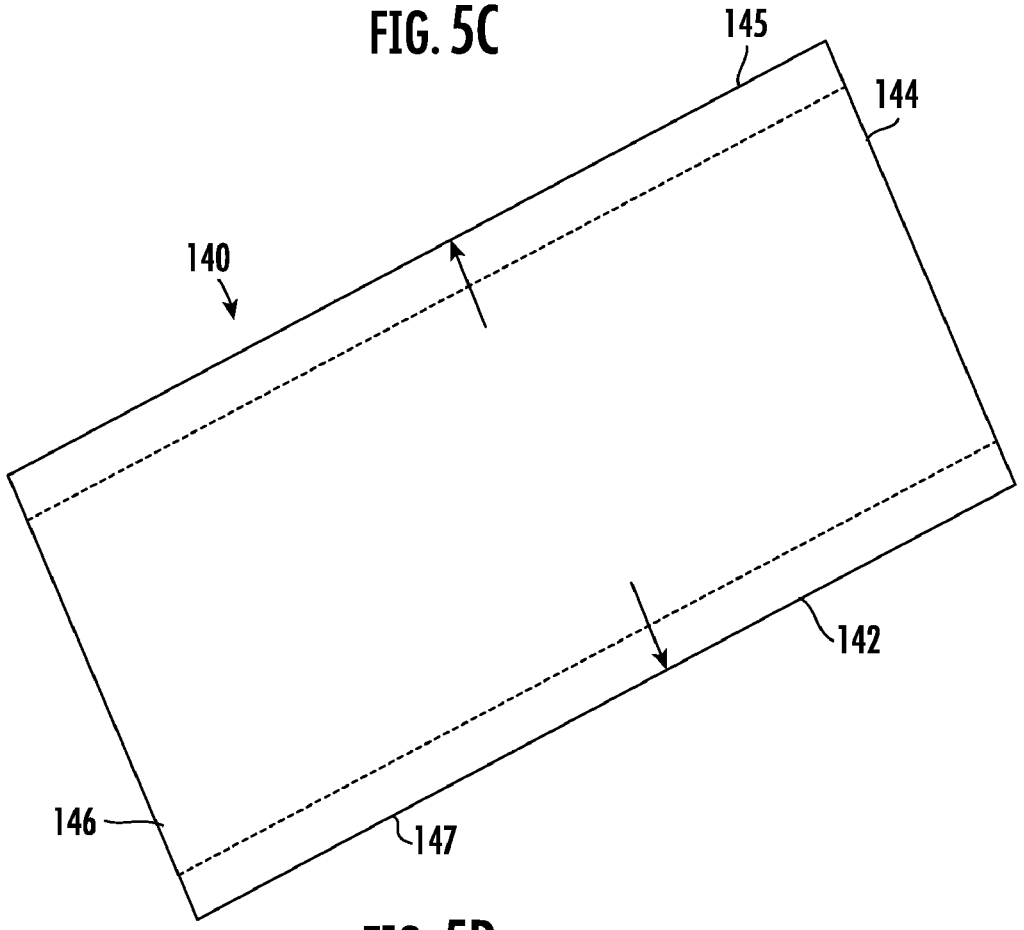
FIG. 5D illustrates the example woven seamed structure of FIGS. 5A-5C in a stretched state according to the arrows shown in FIG. 5C, in accordance with some embodiments discussed herein.

FIG. 5C shows the same woven seamed structure 140 that has been removed (e.g., cut) from a weaving machine. When the sides 145 and 147 are pulled apart in a circumferential direction, or when any radial force is applied in the circumferential direction, the woven seamed structure 140 is stretchable to a position with a wider width, as shown in FIG. 5D. The difference in width exhibited by the woven seamed structure 140, which was woven at a non-zero angle, is higher than the difference in width exhibited by a seamed structure woven at a zero angle, as shown in FIGS. 2A-2B. In some embodiments, the change in width from the shorter width to the wider width in FIGS. 5C-5D may be at least 2%. Further, in some embodiments, the change in width from the shorter width to the longer width may be at least 5%; at least 7%, at least 8%, at least 10%; at least 15%; or at least 20%.

In other embodiments, the change in width from the shorter width to the longer width may be any other value.

Notably, while the above indicated testing included woven seamed structures with particular yarn linear densities, fabric thicknesses and fabric densities, various embodiments of the present invention contemplate formation of woven seamed structures with other such properties. For example, in some embodiments, the yarn may define a linear density of less than 300 denier. In some embodiments, the yarn may define a linear density of 200 denier or less. In some embodiments, the yarn may define a linear density of 100 denier or less. In some embodiments, the yarn may define a linear density of 90 denier or less. In some embodiments, the yarn may define a linear density of 85 denier or less. In some embodiments, the yarn may define a linear density of 50 denier or less. In some embodiments, the yarn may define a linear density of 40 denier or less. In some embodiments, the yarn may define a linear density of 20 denier or less. In some embodiments, the yarn may define a linear density of 10 denier or less.

Along similar lines, the fabric thickness of the woven seamed structure may be less than 5 mm, less than 3 mm, less than 2 mm, less than 1 mm, less than 0.5 mm, less than 0.25 mm, less than 0.1 mm, or even less than 0.06 mm. Similarly, the fabric density of the woven seamed structure may be less than 0.5 grams/cm$^3$, less than 0.6 grams/cm$^3$, less than 0.7 grams/cm$^3$, less than 0.8 grams/cm$^3$, less than 1 grams/cm$^3$, or less than 2 grams/cm$^3$. Additionally or alternatively, the fabric density of the woven seamed structure may be greater than 0.4 grams/cm$^3$, greater than 0.5 grams/cm$^3$, greater than 0.7 grams/cm$^3$, greater than 0.8 grams/cm$^3$, greater than 1 grams/cm$^3$, or greater than 2 grams/cm$^3$.

Figure 5E:
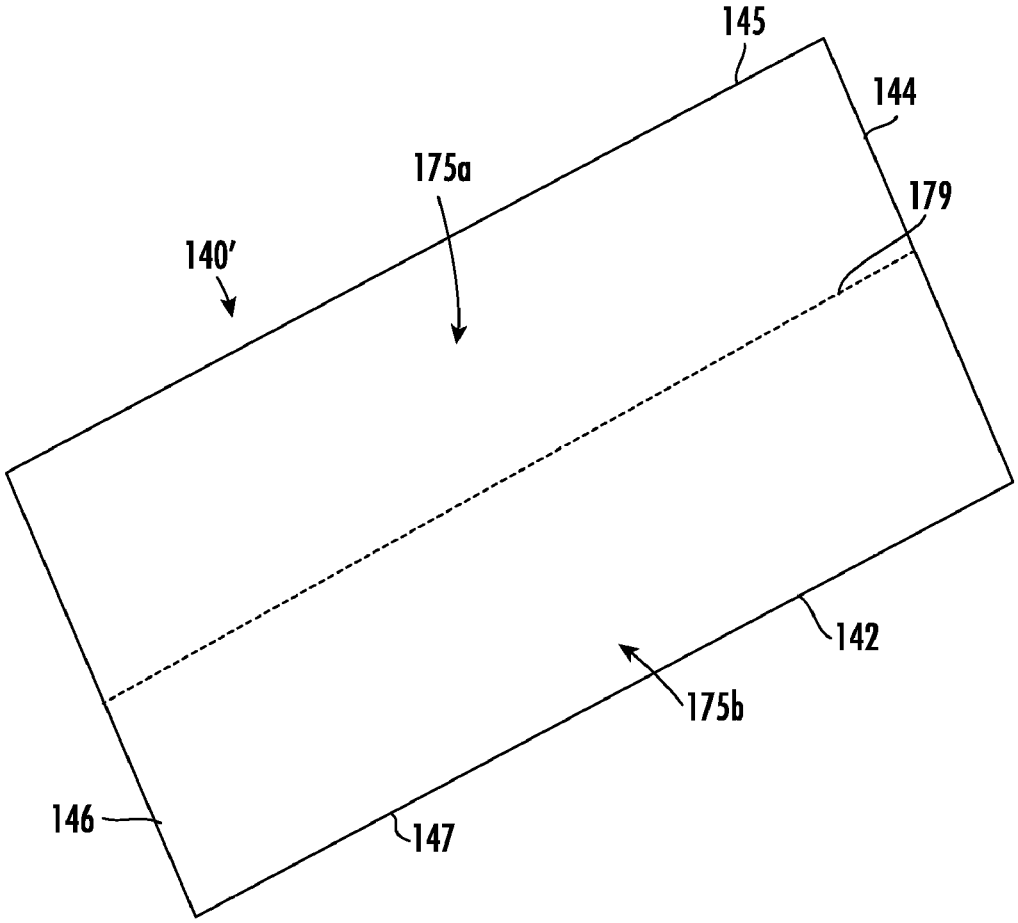
FIG. 5E illustrates the example woven seamed structure of FIGS. 5A-D with a connection weave forming two conduits, in accordance with some embodiments discussed herein.

While the illustrated embodiments of FIGS. 5A-D are shown with the body 142 of the woven seamed structure 140 forming a tubular shape (e.g., with a conduit extending between the first end 146 and the second end 144), many other shapes are contemplated and are able to be formed. In this regard, the body 142 may be formed to have one or more openings, conduits, and/or chambers depending on the desired situation. FIG. 5E, for example, illustrates an example body 142 of a woven seamed structure 140' where a weave 179 down the center of the body 142 formed two conduits 175*a* and 175*b*. In this regard, one or more weaves or connections can be applied to form different structures.

Figure 5F:
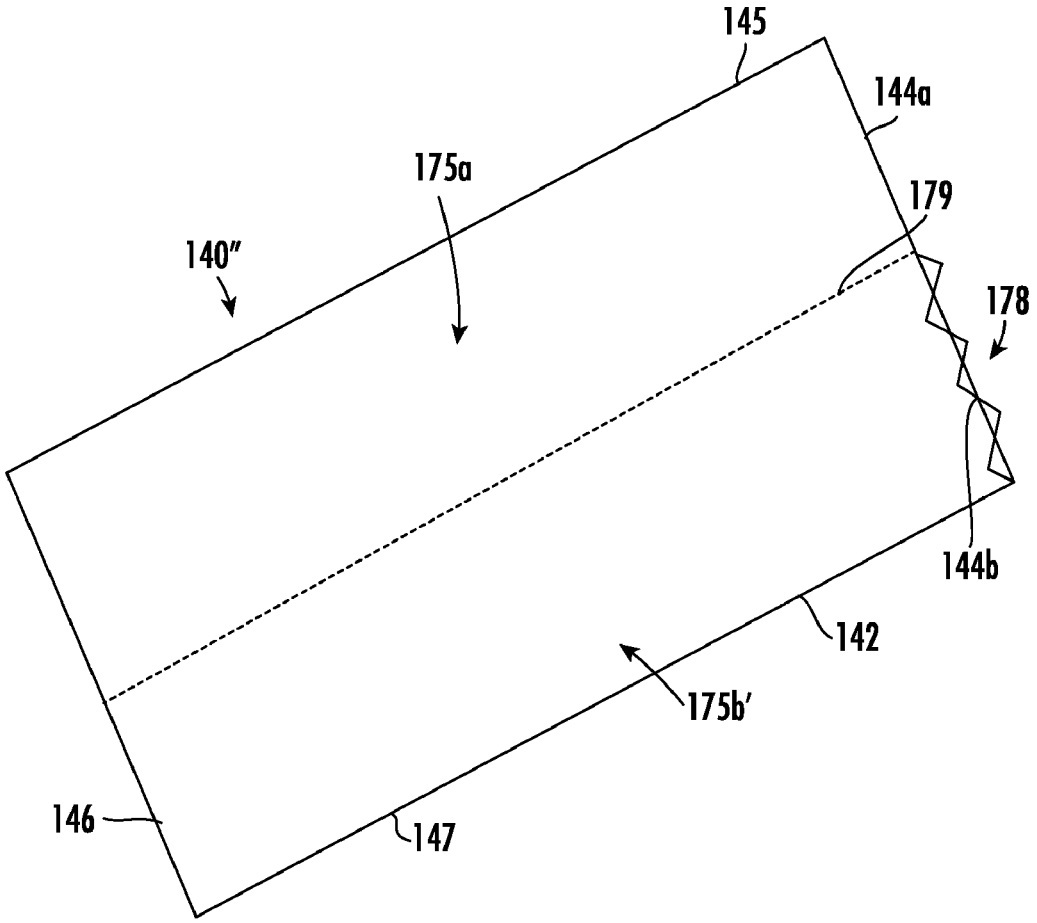
FIG. 5F illustrates the example woven seamed structure of FIG. 5E with a portion of an end being closed to form a chamber, in accordance with some embodiments discussed herein.

In some embodiments, one or more openings may be closed, such as via weaving and/or through additional stitching. FIG. 5F shows an example woven seamed structure 140" where the second end 144 has been separated into two portions 144*a* and 144*b*, where the second portion 144*b* has an opening that has been closed such as by a stitch 178. Notably, this closed the former conduit 175*b*, now forming a chamber 175*b*'. Such configurability is important for different situations that may be needed.

Figure 5G:
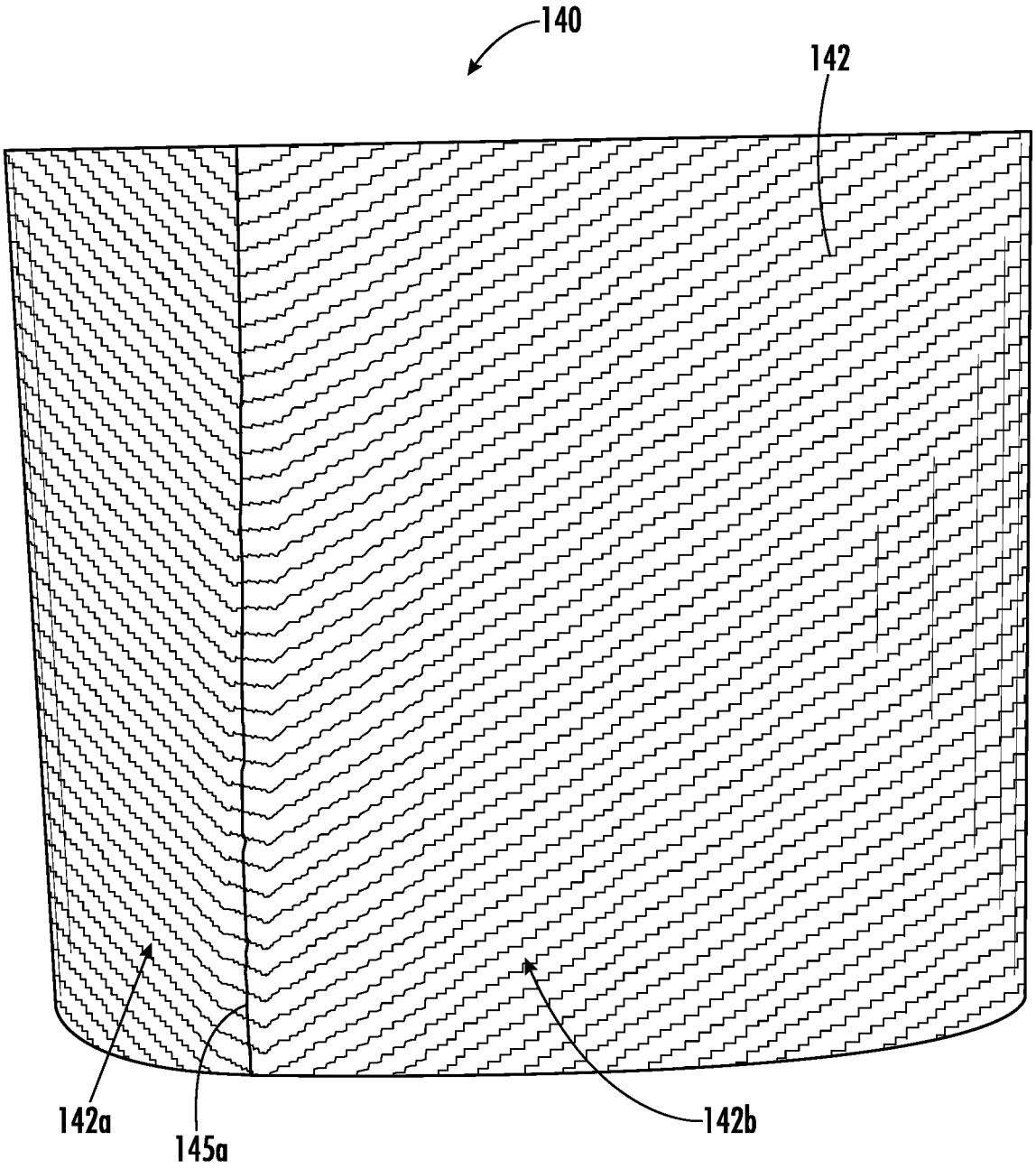
FIG. 5G shows a close-up of a portion of the example woven seamed structure of FIGS. 5A-D, illustrating an example transition line on the body, in accordance with some embodiments discussed herein.

FIG. 5G illustrates a portion of the woven seamed structure 140 of FIGS. 5A-D from the side. As illustrated, a first transition line 145*a* is shown extending between two different patterns of portions 142*a* and 142*b* of the body 142. In this regard, it is illustrated that, in some embodiments, the transition line 112 of FIG. 2, for example, separates two different patterns of the body 142.

In some embodiments, the weaving thread and the plurality of threads may be the same material, while in other embodiments, the weaving thread and the plurality of threads may be different materials. For example, the weaving thread and the plurality of threads may both be the same elastic material. Alternatively, the weaving thread may be a first material with a first modulus of elasticity, and the plurality of threads may be a second material with a second modulus of elasticity. The first modulus of elasticity and the second modulus of elasticity may be the same or different.

Different materials may allow for woven seamed structures to have varying stretchability in a longitudinal direction. In some embodiments, the threads may be any textile strand, including any filament, filament yarn (including single filament or multi-filament yarns) or spun yarn. Likewise, the threads may be of synthetic or natural material. In some embodiments, the threads may be a synthetic biocompatible material, such as, but not limited to, polyester, polypropylene, polyethylene, polyurethane, silicone, polytetrafluorethylene (PTFE), polyglactin, polyglycolic acid, trimethylene carbonate, poly-4-hydroxy butyrate (P4HB), polyglycolide, polyactide, and trimethylene carbonate (TMC). In other embodiments, the threads may comprise a combination of synthetic and/or natural materials, for example silk. In some embodiments, one or both of the weaving thread and/or the plurality of threads may be comprised of polyester, ultra-high molecular weight polyolefin (UHMWP) and/or ultra-high molecular weight polyethylene (UHMWPE).

FIG. 6 shows a weaving machine 150 with a let off shaft 152 and a take up shaft 154 extending parallel to a weft axis WE. A plurality of threads extend parallel to a warp axis WA between the shafts 152 and 154, and at least one weaving thread is woven back and forth into the plurality of threads in directions (e.g., in the first direction D1 and then the second direction D2) parallel to the weft axis WE. The weaving thread is woven in a machine direction MD, which is parallel to the warp axis WA, such that a pattern of the weaving thread changes gradually or intermittently at positions along the weft axis WE as it is woven in the machine direction MD. The result is a woven seamed structure such as the woven seamed structure 155, which has a central axis A3 that has the same non-zero angle β from the warp axis WA as does the transition lines 153 and 151. The non-zero angle β depicted in FIG. 6 is, for example, 85 degrees, although other non-zero angles are contemplated.

Figure 7A:
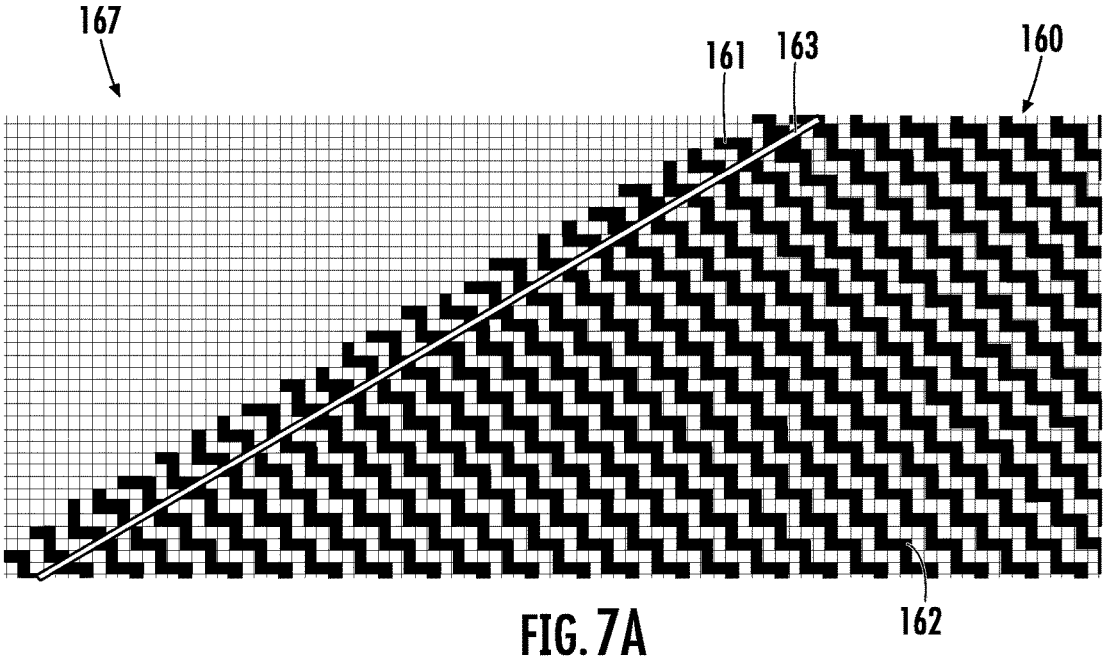
FIG. 7A illustrates a zoomed-in view of an example portion of a woven seamed structure on a weaving machine, in accordance with some embodiments discussed herein.
Figure 7B:
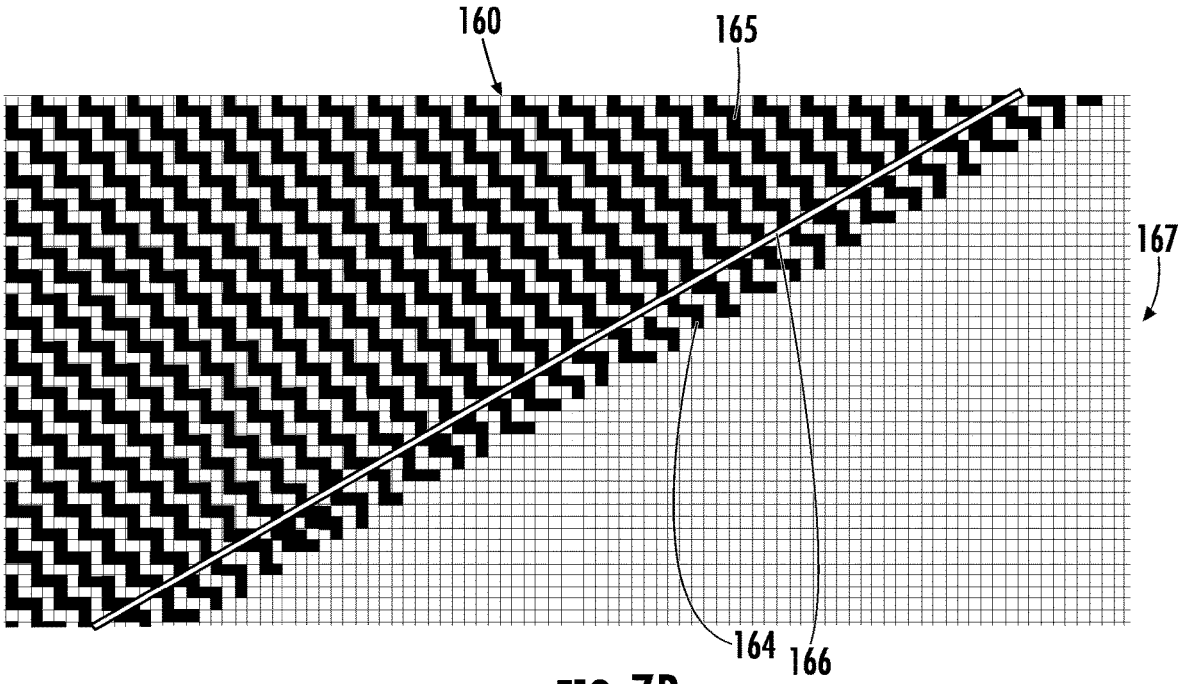
FIG. 7B illustrates another zoomed-in view of another example portion of the woven seamed structure of FIG. 7A, in accordance with some embodiments discussed herein.

FIG. 7A is a zoomed-in view of a top edge of a woven seamed structure 160 being woven on a weaving machine 167 in the manner discussed above, such that the woven seamed structure 160 has a central axis having a non-zero angle with the warp axis. In the configuration shown, an over-under pattern is being used for both the body 162 of the woven seamed structure 160 and for the outer transition line portion 161. The over-under pattern is reversed to form the transition line 163. Similarly, FIG. 7B is a zoomed-in view of a bottom edge of the woven seamed structure 160 being woven on the weaving machine 167. An over-under pattern is being used for both the body 165 of the woven seamed structure 160 and for the outer transition line portion 164. The over-under pattern is reversed to form the transition line 166. Once the woven seamed structure 160 has been woven, it can be cut from the weaving machine 167. Further, either before or after the woven seamed structure 160 is cut from the weaving machine 167, seams can be formed along the transition lines 163, 166, such as by interlacing together one or more threads so as to form, for example, reinforced and/or non-permeable edges.

Figure 8A:
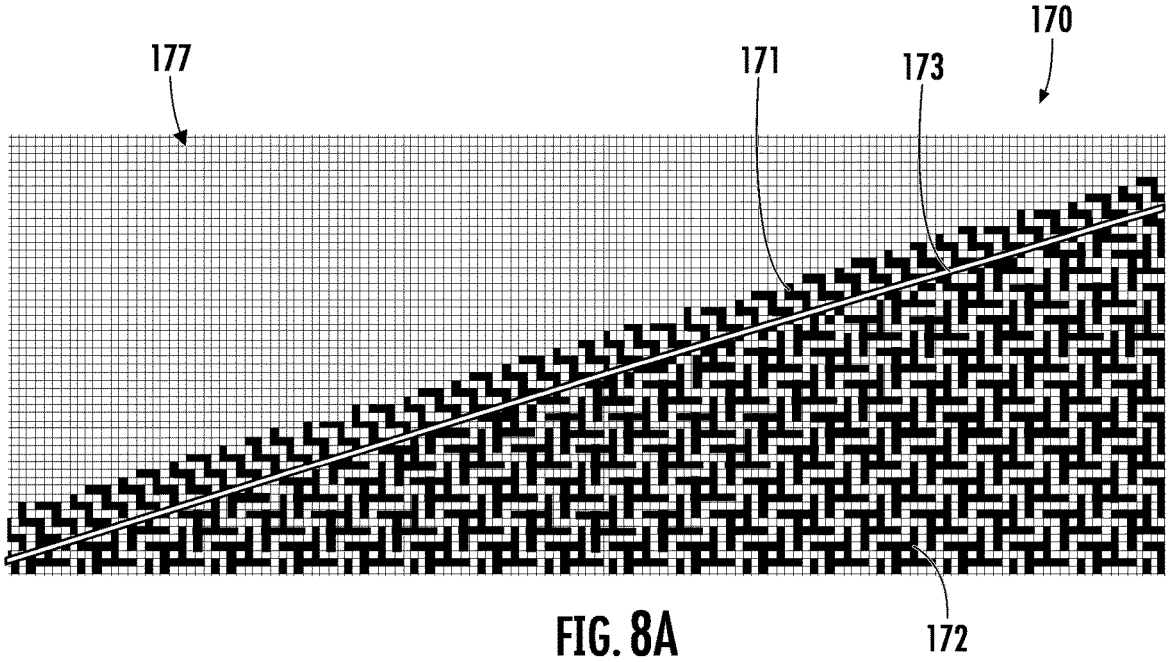
FIG. 8A illustrates a zoomed-in view of an example portion of a woven seamed structure on a weaving machine, in accordance with some embodiments discussed herein.
Figure 8B:
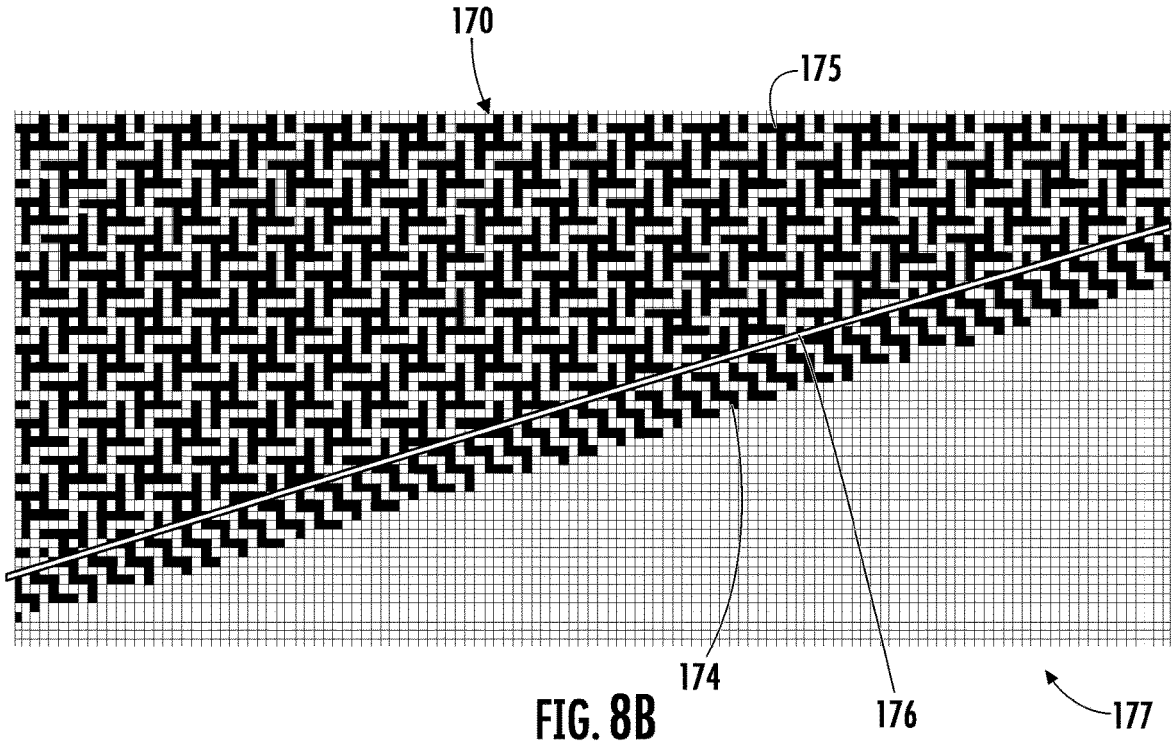
FIG. 8B illustrates another zoomed-in view of another example portion of the woven seamed structure of FIG. 8A, in accordance with some embodiments discussed herein.

FIG. 8A is a zoomed-in view of a top edge of a woven seamed structure 170 being woven on a weaving machine 177. In the configuration shown, a twill pattern is being used for the body 172 of the woven seamed structure 170 and an over-under pattern is being used for the outer transition line portion 171. The twill pattern is changed to the over-under pattern to form the transition line 173. Similarly, FIG. 8B is a zoomed-in view of a bottom edge of the woven seamed structure 170 being woven on the weaving machine 177. A twill pattern is being used for the body 175 of the woven seamed structure 170 and an over-under pattern is being used for the outer transition line portion 174. The twill pattern is changed to the over-under pattern to form the transition line 176. Once the woven seamed structure 170 has been woven, it can be cut from the weaving machine 177. Further, either before or after the woven seamed structure 170 is cut from the weaving machine 177, seams can be formed along the transition lines 173, 176, such as by interlacing together one or more threads so as to form, for example, reinforced and/or non-permeable edges.

Figure 9A:
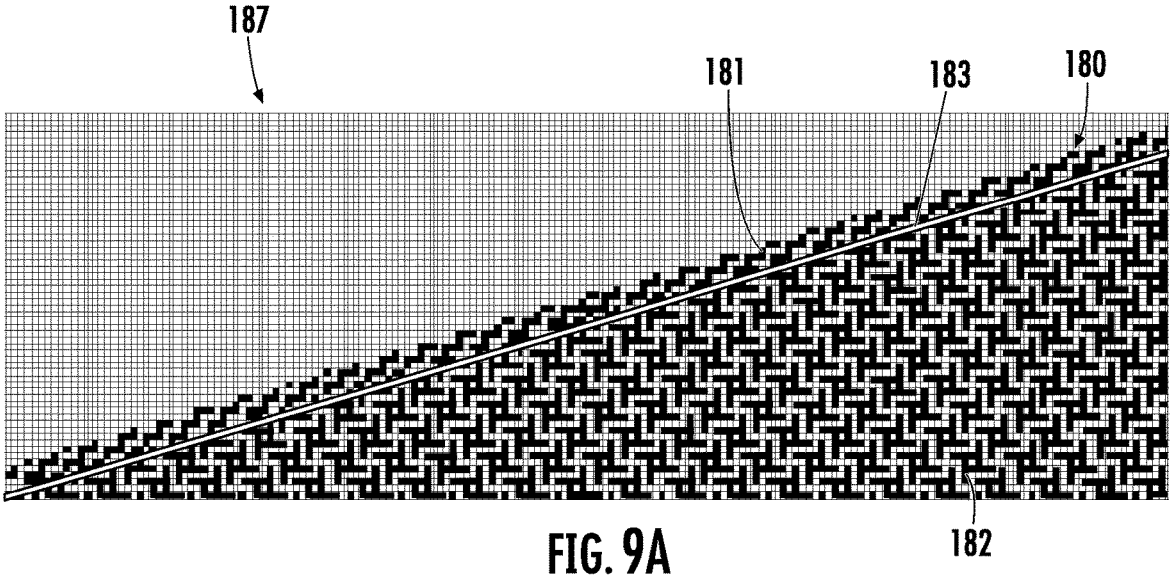
FIG. 9A illustrates a zoomed-in view of an example portion of a woven seamed structure on a weaving machine, in accordance with some embodiments discussed herein.
Figure 9B:
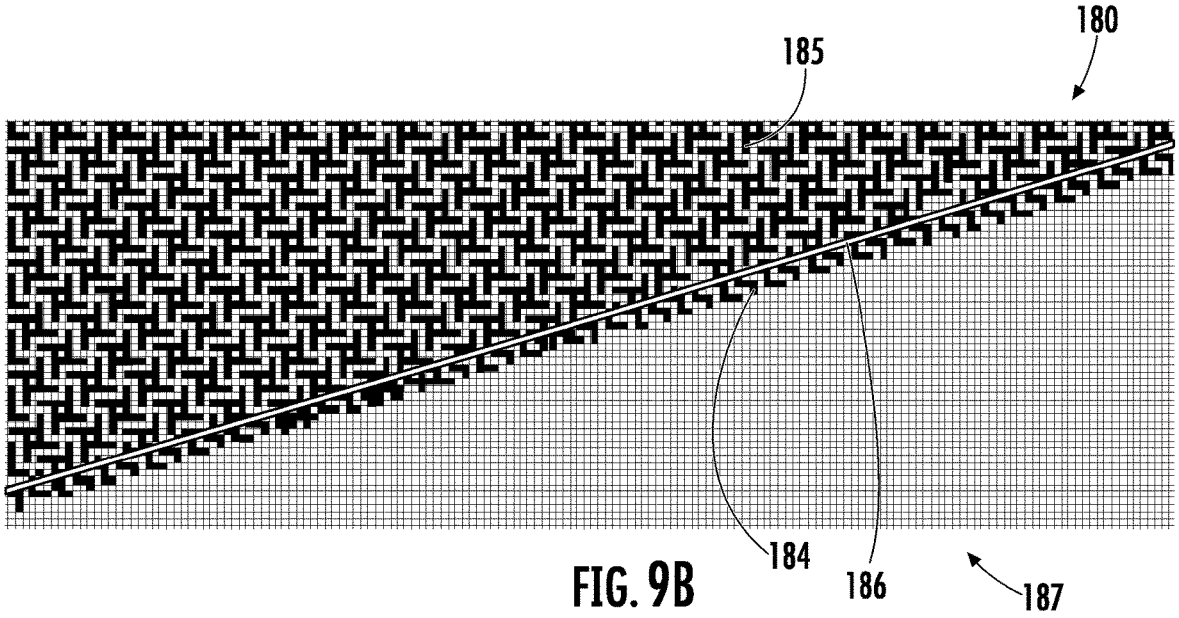
FIG. 9B illustrates another zoomed-in view of another example portion of the woven seamed structure of FIG. 9A, in accordance with some embodiments discussed herein.

FIG. 9A is a zoomed-in view of a top edge of a woven seamed structure 180 being woven on a weaving machine 187. In the configuration shown, a twill pattern is being used for the body 182 of the woven seamed structure 180 and a reverse over-under pattern is being used for the outer transition line portion 181. The twill pattern is changed to the reverse over-under pattern to form the transition line 183. Similarly, FIG. 9B is a zoomed-in view of a bottom edge of the woven seamed structure 180 being woven on the weaving machine 187. A twill pattern is being used for the body 185 of the woven seamed structure 180 and a reverse over-under pattern is being used for the outer transition line portion 184. The twill pattern is changed to the reverse over-under pattern to form the transition line 186. Once the woven seamed structure 180 has been woven, it can be cut from the weaving machine 187. Further, either before or after the woven seamed structure 180 is cut from the weaving machine 187, seams can be formed along the transition lines 183, 186, such as by interlacing together one or more threads so as to form, for example, reinforced and/or non-permeable edges.

As mentioned above, a woven seamed structure may be cut or otherwise removed from a weaving machine. For example, in some embodiments, the woven seamed structure may be cut in an area outside of the outer transition line portions of the woven seamed structure. Before or after the woven seamed structure is cut or otherwise removed from the weaving machine, the outer transition line portions (shown in FIGS. 7A-7B, 8A-8B, and 9A-9B) may be, in some embodiments, tied together to form seams. The resulting seams may be straight, and in some embodiments, the two seams of a woven seamed structure may be parallel such that the woven seamed structure maintains a constant diameter along its length.

After a woven seamed structure has been woven on a weaving machine and then cut from the weaving machine, the weaving machine may recalibrate the positions of the plurality of threads such that a second woven seamed structure can be formed. This may include adjusting the plurality of threads to, e.g., maintain a specific tension and/or spacing to ensure that subsequent woven seamed structures that are woven on the same weaving machine have the same or similar stretchability capabilities. Although many embodiments may include this recalibration step, it should be appreciated that recalibration of the plurality of threads between weaving woven seamed structures is not necessary.

Figure 10A:
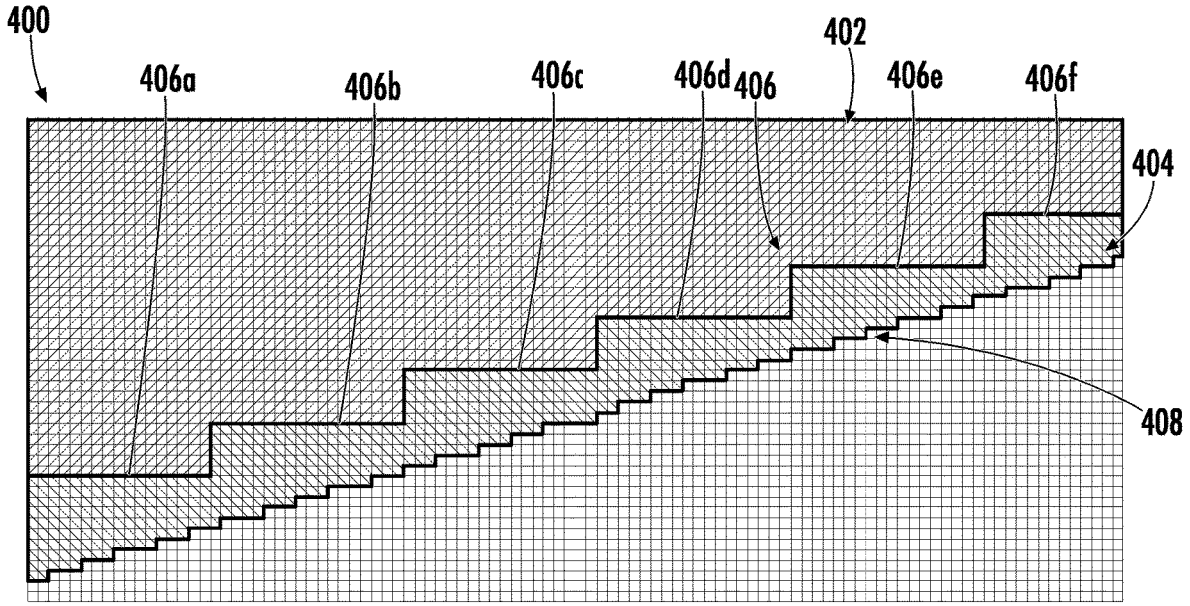
FIG. 10A illustrates a zoomed-in view of an example portion of a woven seamed structure on a weaving machine, in accordance with some embodiments discussed here.

In some embodiments, the weaving thread may be configured to change the pattern gradually in the machine direction, and in some other embodiments, the weaving thread may be configured to change the pattern intermittently in the machine direction. For example, FIG. 10A is a zoomed-in view of a bottom edge of a woven seamed structure being woven on a weaving machine 400. In the embodiment shown, the woven seamed structure is woven by changing a pattern 402 to a pattern 404 intermittently in a machine direction parallel to the warp axis. The intermittent nature of the pattern change is shown by the plurality of stairsteps 406 (e.g., 406*a*, 406*b*, 406*c*, 406*e*, 406*f*). For example, the weaving thread is configured to change between the pattern 402 and the pattern 404 at a first position with respect to the weft axis to form the first stairstep 406*a*, and then the weaving thread is configured to change between the pattern 402 and the pattern 404 at a second position with respect to the weft axis to form the second stairstep 406. The first position and the second position are at different locations with respect to the weft axis such that, along the warp axis in the machine direction, the pattern is changed intermittently. In some further embodiments, once the weaving thread has changed between the pattern 402 and the pattern 404, the weaving thread may be completely disengaged for the remainder of the plurality of threads along the weft axis. The edges 408 show where the weaving thread has transitioned from being woven into the plurality of threads in pattern 404 to being disengaged from the plurality of threads completely.

Figure 10B:
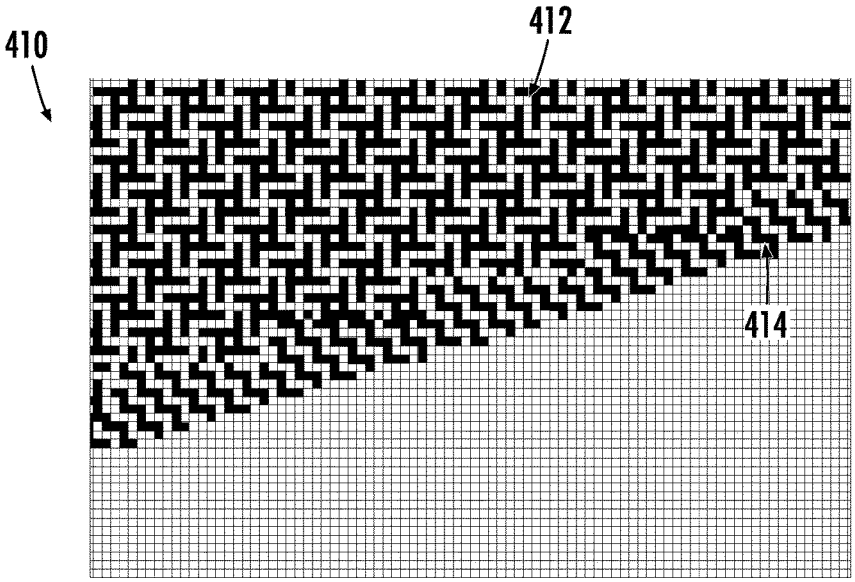
FIG. 10B illustrates another zoomed-in view of another example portion of a woven seamed structure on a weaving machine, in accordance with some embodiments discussed herein.

FIG. 10B shows a zoomed-in view of a bottom edge of a woven seamed structure on a weaving machine 410. The bottom edge is formed by intermittently changing the first pattern 412 to the second pattern 414. In the embodiment shown in FIG. 10B, the first pattern 412 is a twill weave pattern, and the second patter 414 is an over-under weave pattern.

Figure 11A:
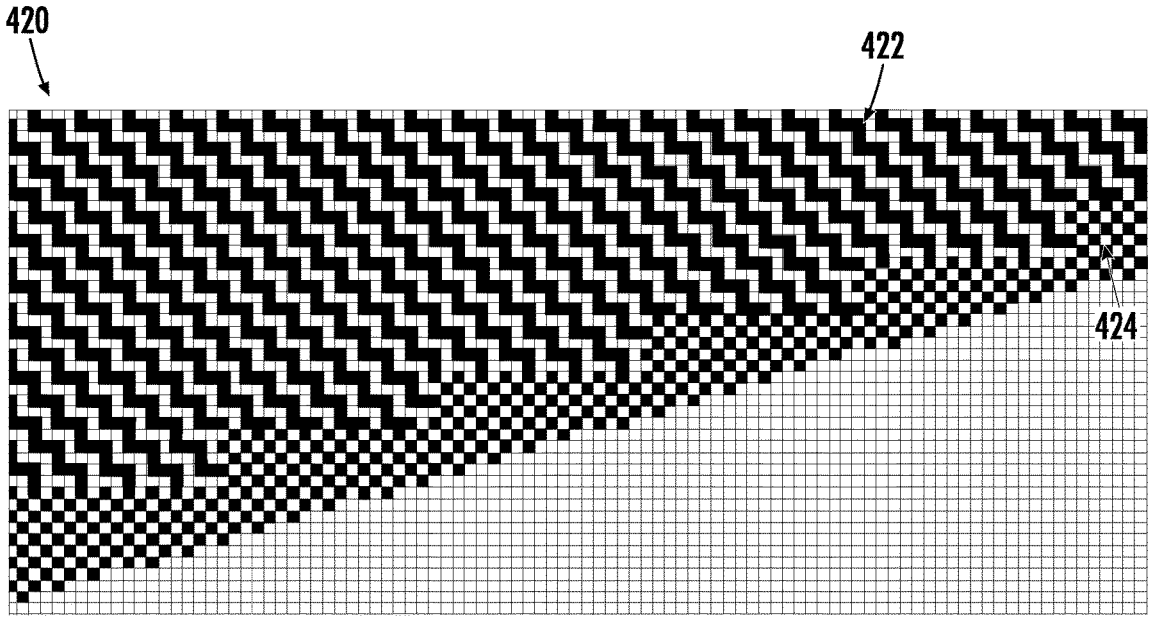
FIG. 11A illustrates a zoomed-in view of an example portion of a woven seamed structure on a weaving machine, in accordance with some embodiments discussed herein.
Figure 11B:
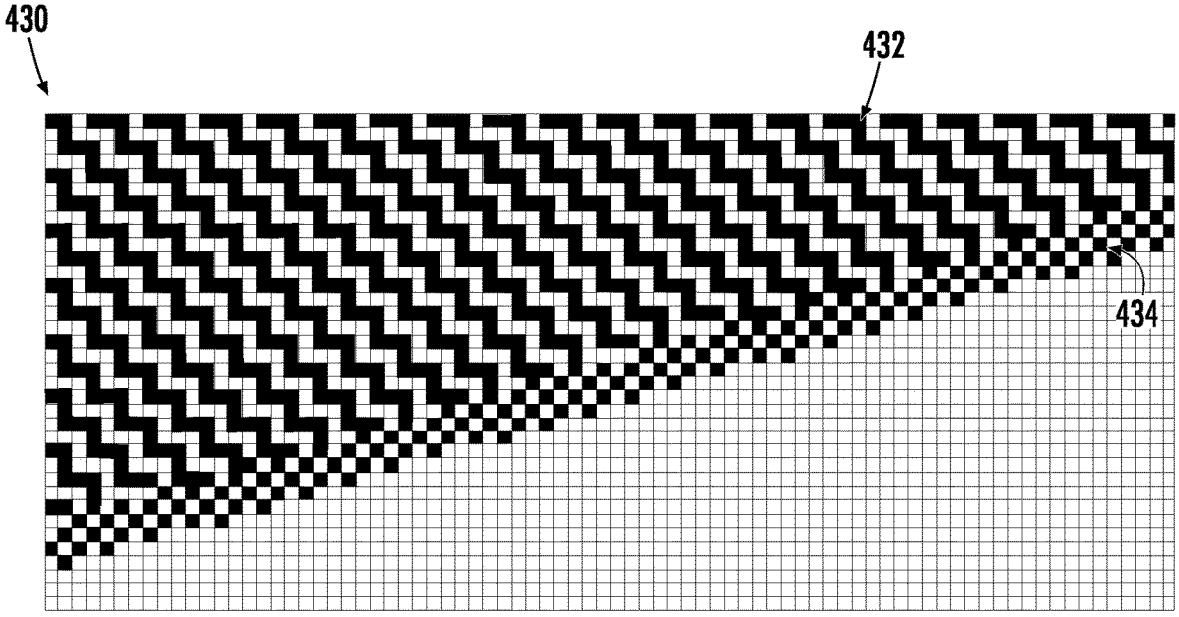
FIG. 11B illustrates another zoomed-in view of another example portion of a woven seamed structure on a weaving machine, in accordance with some embodiments discussed herein.

FIG. 11A is a zoomed-in view of a bottom edge of a woven seamed structure being woven on a weaving machine 420. In the embodiment shown in FIG. 11A, the woven seamed structure is woven by changing between a first pattern 422 and a second pattern 424 intermittently in the machine direction. FIG. 11B is a zoomed-in view of a bottom edge of a woven seamed structure being woven on a weaving machine 430. In the embodiment shown in FIG. 11B, the woven seamed structure is woven by changing between a first pattern 432 and a second pattern 434 gradually in the machine direction. In the embodiments shown in FIGS. 11A-11B, the first pattern is an over-under weave pattern, and the second pattern is a reversed over-under weave pattern.

Figure 12A:
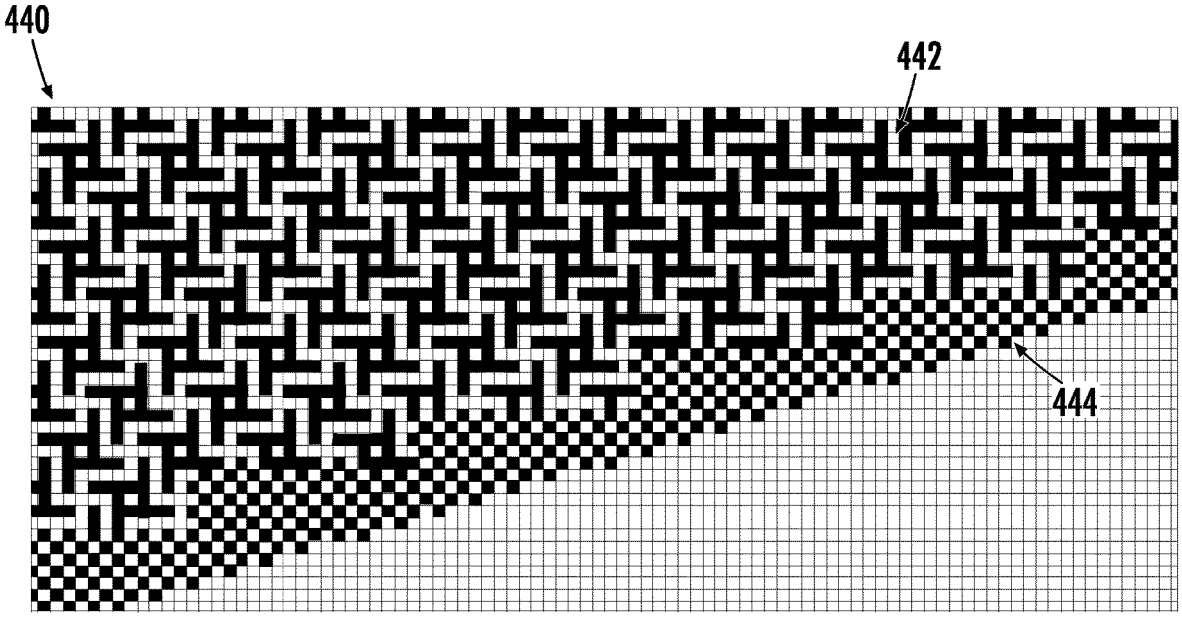
FIG. 12A illustrates a zoomed-in view of an example portion of a woven seamed structure on a weaving machine, in accordance with some embodiments discussed herein.
Figure 12B:
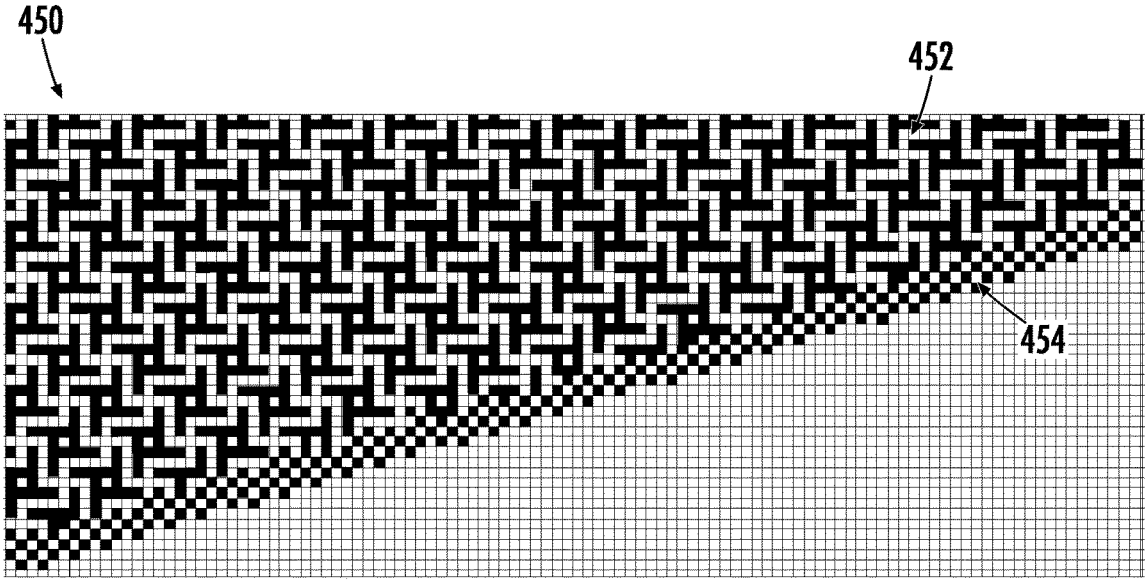
FIG. 12B illustrates another zoomed-in view of another example portion of a woven seamed structure on a weaving machine, in accordance with some embodiments discussed herein.

FIG. 12A is a zoomed-in view of a bottom edge of a woven seamed structure being woven on a weaving machine 440. In the embodiment shown in FIG. 12A, the woven seamed structure is woven by changing between a first pattern 442 and a second pattern 444 intermittently in the machine direction. FIG. 12B is a zoomed-in view of a bottom edge of a woven seamed structure being woven on a weaving machine 450. In the embodiment shown in FIG. 12B, the woven seamed structure is woven by changing between a first pattern 452 and a second pattern 454 gradually in the machine direction. In the embodiments shown in FIGS. 12A-12B, the first pattern is a twill weave pattern, and the second pattern is an over-under weave pattern.

Figure 13A:
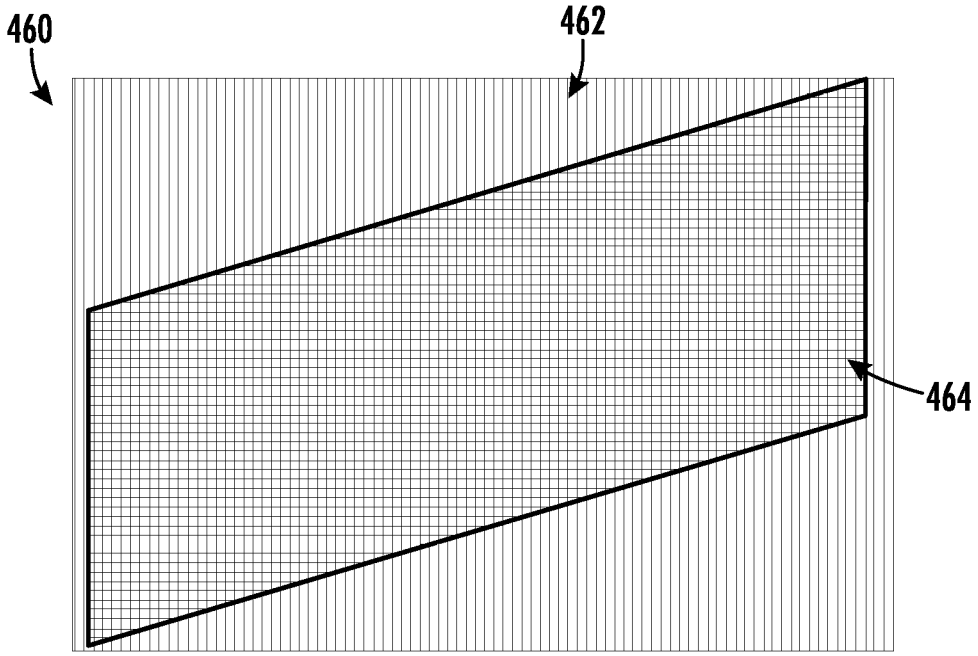
FIG. 13A shows an example woven seamed structure on a weaving machine, the woven seamed structure being woven in conjunction with a sheet of fabric, in accordance with some embodiments discussed herein.
Figure 13B:
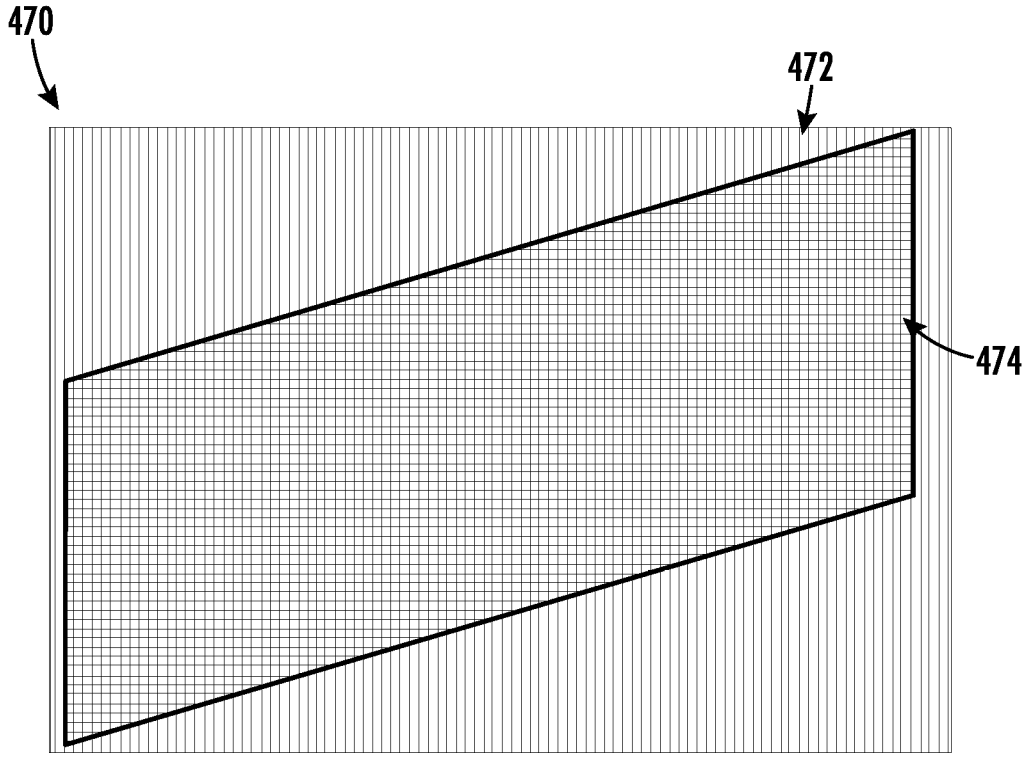
FIG. 13B shows another example woven seamed structure on a weaving machine, the woven seamed structure being woven in conjunction with a sheet of fabric, in accordance with some embodiments discussed herein.

In some embodiments, a woven seamed structure may be woven in conjunction with a sheet of fabric. That is, the at least one weaving thread is woven into a plurality of threads that form a sheet of fabric, where the at least one weaving thread is used to divide the sheet of fabric into the multi-layered woven seamed structure before the plurality of threads are returned to making the sheet of fabric. In this regard, the woven seamed structure can be formed during formation of a sheet of fabric, such as using a rapier loom. For example, FIG. 13A shows a sheet of fabric 462 on a weaving machine 460. The weaving thread(s) interact with the plurality of threads that form the sheet of fabric 462 in a way that is similar to the previous-described embodiments such that a woven seamed structure 464 is formed with the sheet of fabric 462. Similarly, FIG. 13B shows that an over-under pattern is used to weave the body of the woven seamed structure 474 with the sheet of fabric 472 on the weaving machine 470.

Figure 14A:
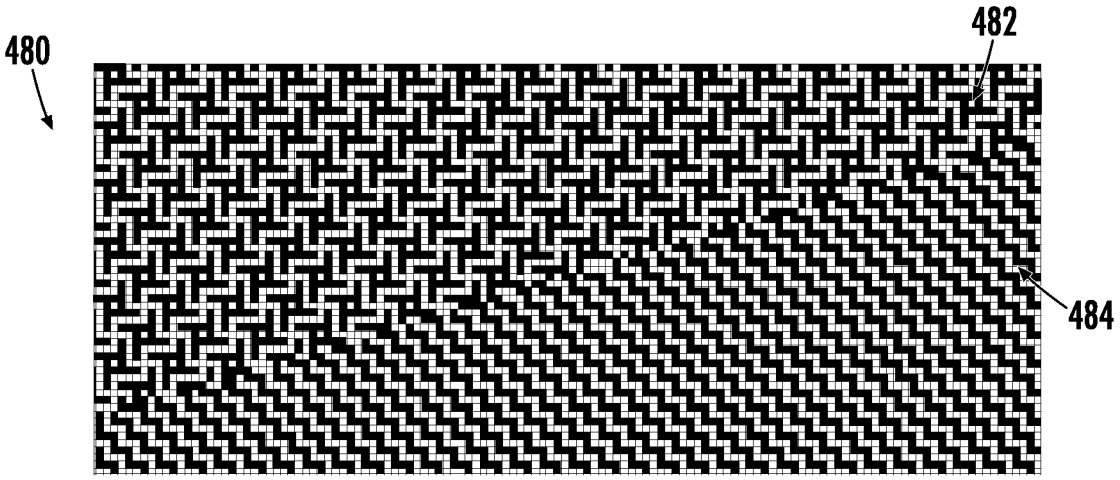
FIG. 14A illustrates a zoomed-in view of an example portion of a woven seamed structure on a weaving machine, the woven seamed structure being woven in conjunction with a sheet of fabric, in accordance with some embodiments discussed herein.
Figure 14B:
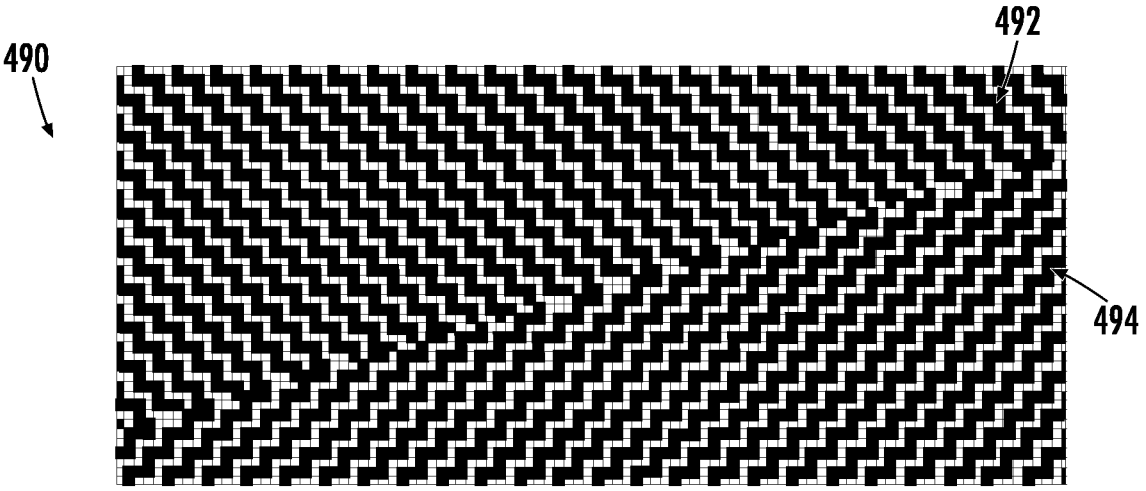
FIG. 14B illustrates a zoomed-in view of an example portion of another woven seamed structure on a weaving machine, the woven seamed structure being woven in conjunction with a sheet of fabric, in accordance with some embodiments discussed herein.
Figure 14C:
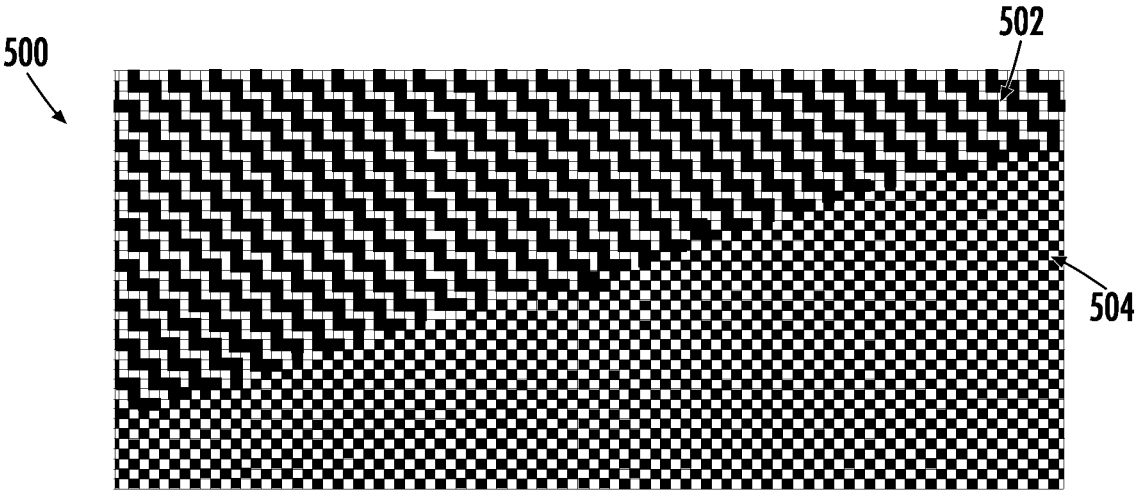
FIG. 14C illustrates a zoomed-in view of an example portion of another woven seamed structure on a weaving machine, the woven seamed structure being woven in conjunction with a sheet of fabric, in accordance with some embodiments discussed herein.

FIGS. 14A-14C are zoomed-in views of bottom edges of various woven seamed structures that are woven in conjunction with sheets of fabric. Specifically, FIG. 14A shows a woven seamed structure 482 formed with the sheet of fabric 484 on a weaving machine 480, where the woven seamed structure 482 is woven using a first pattern (e.g., a twill weave pattern), and the first pattern is gradually or intermittently transitioned to a second pattern (e.g., an over-under weave pattern) at different positions along the weft axis as the woven seamed structure is woven in the machine direction such that a transition line is formed, as shown. FIG. 14B shows a woven seamed structure 492 formed with a sheet of fabric 494 on a weaving machine 490, where the woven seamed structure 492 is woven using a first pattern (e.g., an over-under weave pattern), and the first pattern is gradually or intermittently transitioned to a second pattern (e.g., an over-under weave pattern) at different positions along the weft axis as the woven seamed structure is woven in the machine direction such that a transition line is formed, as shown. FIG. 14C shows a woven seamed structure 502 formed with a sheet of fabric 504 on a weaving machine 500, where the woven seamed structure 502 is woven using a first pattern (e.g., an over-under weave pattern), and the first pattern is gradually or intermittently transitioned to a second pattern (e.g., a pattern in which all threads are completely disengaged or passed over) at different positions along the weft axis as the woven seamed structure is woven in the machine direction such that a transition line is formed, as shown.

In some embodiments, the at least one weaving thread may be configured to change patterns so as to form transition lines that extend at non-zero angles from the warp axis and that are irregularly shaped. For example, FIG. 15A shows a woven seamed structure 510 with a first transition line 514 and a second transition line 516, the woven seamed structure being woven in between the transition lines 514 and 516 with pattern 512. Both of the transition lines 514 and 516 are irregularly shaped. More specifically, FIG. 15B is a zoomed-in view of a portion of an irregular top edge of a woven seamed structure 520 woven by changing a weaving thread between being woven with a first pattern 524 and a second pattern 522. Similarly, FIG. 15B is a zoomed-in view of a portion of an irregular bottom edge of a woven seamed structure 530 woven by changing a weaving thread between being woven with a first patter 534 and a second pattern 532.

Figure 16:
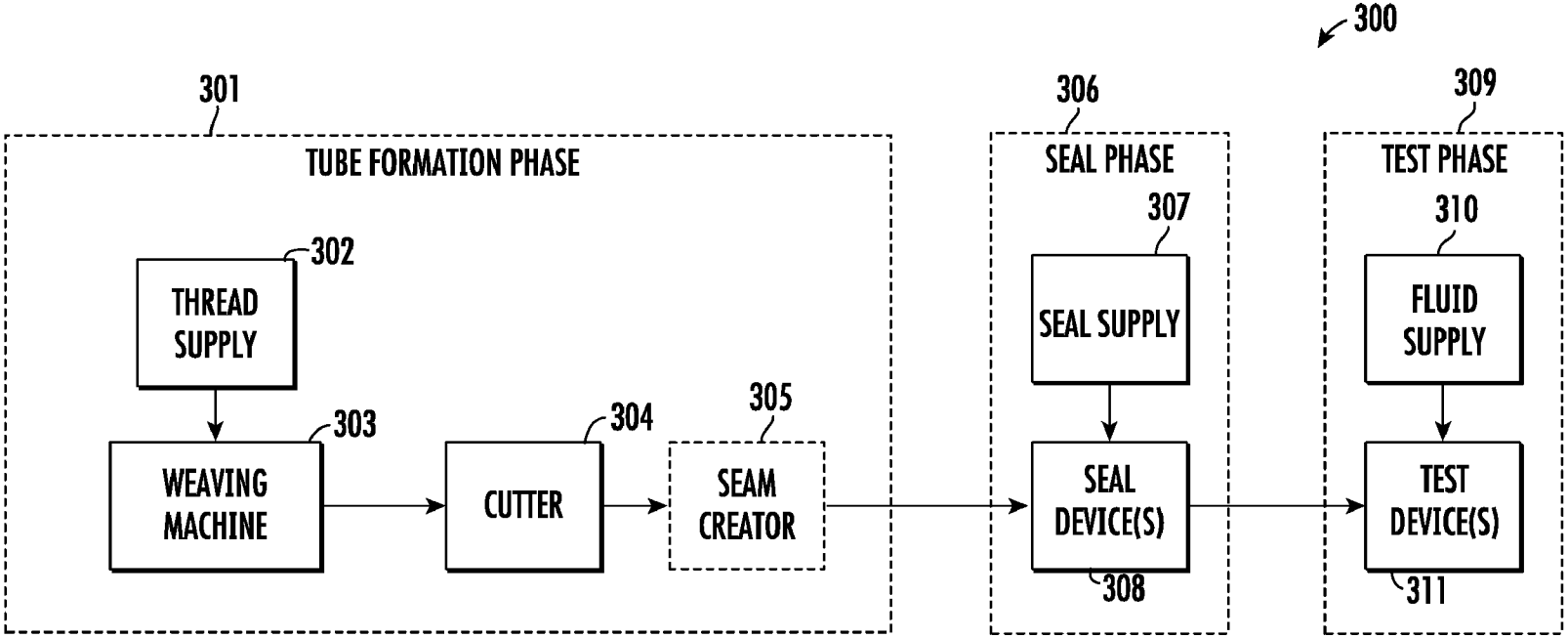
FIG. 16 is a block diagram of an example process for manufacturing a woven seamed structure, in accordance with some embodiments discussed herein.

FIG. 16 is a block diagram showing an example process 300 for manufacturing a woven seamed structure. The process 300 comprises a woven seamed structure formation phase 301, a seal phase 306, and a test phase 309. In the embodiment shown in FIG. 16, the woven seamed structure formation phase 301 has a thread supply 302 that feeds into a weaving machine 303. For example, the weaving machine 303 may be a machine configured to weave threads together. Specifically, in some embodiments, the weaving machine 303 may be a machine configured to weave a weaving thread into a plurality of threads to form a woven seamed structure. As described herein, the pattern of the weaving thread may be changed at positions along the weft axis that gradually or intermittently change as the weaving thread moves in the machine direction such that the resulting woven seamed structure has a central axis that forms a non-zero angle with respect to the warp axis. A cutter 304 may then be used to cut the woven seamed structure from the weaving machine 303. The cutter 304 may be optional, though, depending on the type of weaving machine 303 used. Alternatively, the cutter 304 may be integrated into the weaving machine 303 (e.g., the weaving machine 303 may include the cutter 304 in the same mechanism). A seam creator 305 may then be optionally used. As described herein, the seam creator 305 may be used to form seams along transition lines, such as by interlacing together one or more threads so as to form, for example, reinforced and/or non-permeable edges. It should be appreciated that, in some embodiments, seams may be formed while the woven seamed structure is still on the weaving machine 303, so the seam creator 305 may not be needed. Further, in some embodiments, a portion of the seams may be formed while the woven seamed structure is on the weaving machine 303, and the seam creator 305 may be used to form the rest of the seams. In some other embodiments, the seam creator 305 may be used to form all of the seams.

Still referring to FIG. 16, the seal phase 306, which may be optional within the process 300, may include a seal supply 307 which may be connected to one or more seal devices 308. During the seal phase 306, the woven seamed structure may go through a sealing process to form a seal around the woven seamed structure that prevents fluid from flowing through wall(s) of the woven seamed structure (e.g., outwardly from within the woven seamed structure or inwardly into the woven seamed structure). For example, the seal supply 307 may contain a sealant and provide the sealant to the seal device(s) 308. The sealant may be applied to the woven seamed structure by seal device(s) 308 by spraying the sealant onto the woven seamed structure, for example. In other embodiments, the sealant may be applied in any other way (e.g., dipping the woven seamed structure in the sealant, painting the sealant on the wall(s) of the woven seamed structure, etc.). The process 300 may also include test phase 309, which is also optional. In the test phase 309, a fluid supply 310 may be connected to one or more test devices 311. In some embodiments, the test phase 309 may involve connecting the woven seamed structure to a water inlet and a water outlet and transferring water through the woven seamed structure to make sure that no fluid flows outwardly from within the woven seamed structure during the passing of the water. It should be appreciated that each of the elements of the process 300 may be optional or may be integrated with other elements of the process 300. Further, certain elements may be in a different order/position in other embodiments. For example, the seal phase 306 may be integrated in the woven seamed structure formation phase 301 (e.g., a sealant may be applied to the woven seamed structure while it is being formed).

Figure 17:
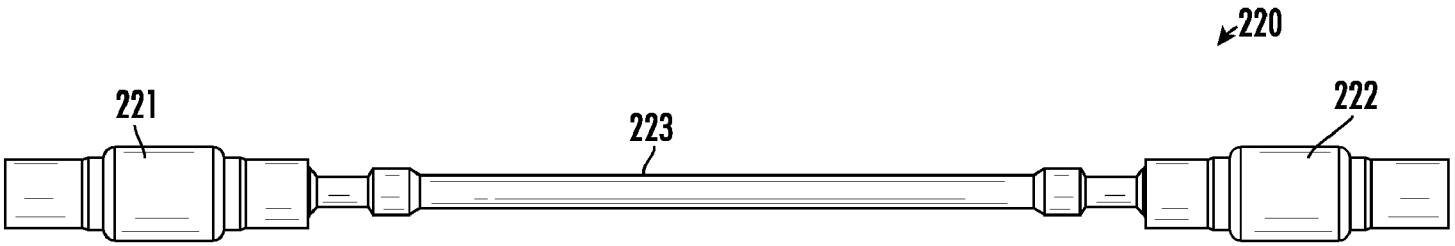
FIG. 17 illustrates an example woven seamed structure disposed within a water inlet and a water outlet for leak testing, in accordance with some embodiments discussed herein.

FIG. 17 illustrates an example woven seamed structure 223 that is being tested in a testing system 220. The woven seamed structure 223 is connected to a water inlet 221 and a water outlet 222. In the testing configuration shown, the woven seamed structure 223 is connected to the water inlet 221 and the water outlet 222 in a way that mimics implantation into a body to, e.g., for a blood vessel. Pressurized water is pushed through the woven seamed structure 223 from the water inlet 221 to the water outlet 222, and testing is performed on the woven seamed structure 223 to ensure that no leaking occurs. That is, the woven seamed structure 223 is tested to make sure that it is fully sealed to prevent fluid from flowing outwardly from within the woven seamed structure 223. It should be appreciated that the woven seamed structure 223 could be tested in any other way with any other fluid.

CONCLUSION

Many modifications and other embodiments of the inventions set forth herein may come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A woven seamed structure, the woven seamed structure comprising:

a plurality of threads extending parallel to each other in a first direction;

at least one weaving thread woven into the plurality of threads back and forth in a second direction perpendicular to the first direction;

a first transition line extending at a first non-zero angle from the first direction, wherein the first transition line is not parallel to the second direction, the first transition line being formed by a first change in pattern during weaving of the at least one weaving thread, wherein the first transition line extends along an edge of the woven seamed structure;

a second transition line extending at a second non-zero angle from the first direction, wherein the second transition line is not parallel to the second direction, the second transition line being formed by a second change in pattern during weaving of the at least one weaving thread, wherein the second transition line extends along the edge of the woven seamed structure; and a body formed from the plurality of threads and the at least one weaving thread, wherein the body includes the first transition line and the second transition line.

2. The woven seamed structure of claim 1, wherein the body defines a central axis that extends along a third non-zero angle from the first direction.

3. The woven seamed structure of claim 2, wherein the first non-zero angle, the second non-zero angle, and the third non-zero angle are the same.

4. The woven seamed structure of claim 2, wherein the first non-zero angle, the second non-zero angle, and the third non-zero angle are different.

5. The woven seamed structure of claim 1, wherein the body defines a tubular shape.

6. The woven seamed structure of claim 1, wherein the body defines a plurality of chambers or conduits.

7. The woven seamed structure of claim 1, wherein the plurality of threads are woven together at one or more points between the first transition line and the second transition line.

8. The woven seamed structure of claim 1, wherein the woven seamed structure has a first opening at a first end and a second opening at a second end, wherein the first transition line extends between the first end and the second end, wherein the second transition line extends between the first end and the second end.

9. The woven seamed structure of claim 1, wherein the woven seamed structure has a first opening at a first end and is closed at a second end, wherein the first transition line extends between the first end and the second end, wherein the second transition line extends between the first end and the second end.

10. The woven seamed structure of claim 1, wherein the woven seamed structure is closed at a first end and is closed at a second end, wherein the first transition line extends between the first end and the second end, wherein the second transition line extends between the first end and the second end.

11. The woven seamed structure of claim 1, wherein the first transition line forms a first seam and the second transition line forms a second seam.

12. The woven seamed structure of claim 1, wherein the woven seamed structure has a first opening at a first end and a second opening at a second end.

13. The woven seamed structure of claim 12, wherein the first transition line is straight from the first end to the second end, and wherein the second transition line is straight from the first end to the second end.

14. The woven seamed structure of claim 1, wherein the first non-zero angle is an angle ranging from 30 degrees to 75 degrees.

15. The woven seamed structure of claim 14, wherein the first non-zero angle is an angle ranging from 40 degrees to 50 degrees.

16. The woven seamed structure of claim 1, wherein the plurality of threads and the at least one weaving thread are comprised of a same material.

17. The woven seamed structure of claim 16, wherein the same material is an elastic material.

18. The woven seamed structure of claim 1, wherein the plurality of threads is comprised of a first material, and wherein the at least one weaving thread is comprised of a second material.

19. The woven seamed structure of claim 18, wherein the first material has a first modulus of elasticity, and wherein the second material has a second modulus of elasticity that is different than the first modulus of elasticity.

20. The woven seamed structure of claim 1, wherein a layer of the woven seamed structure between the first transition line and the second transition line exhibits an increase in stretchability along a length direction of the body of at least 175% compared with an otherwise same second woven seamed structure that was formed with one or more transition lines at a zero angle with respect to the first direction or the second direction.

21. The woven seamed structure of claim 1, wherein a layer of the woven seamed structure between the first transition line and the second transition line exhibits an increase in elongation along a length direction of the body of at least 20%.

22. The woven seamed structure of claim 1, wherein the woven seamed structure is formed of yarn comprising 8-80 denier per yarn, wherein a layer of the woven seamed structure between the first transition line and the second transition line exhibits an increase in elongation along a length direction of the body of at least 200% compared to a second woven seamed structure with transition lines formed at a zero angle with respect to the first direction or the second direction, and wherein the second woven seamed structure otherwise comprises the same properties of denier per yarn as the woven seamed structure.

23. The woven seamed structure of claim 1, wherein the woven seamed structure is formed of yarn comprising 200 denier or less.

24. The woven seamed structure of claim 23, wherein the body of the woven seamed structure comprises a fabric thickness of 2 mm or less.

25. A method for forming a woven seamed structure, the method comprising:

providing a plurality of threads extending parallel to each other in a first direction;

providing at least one weaving thread;

weaving the at least one weaving thread into the plurality of threads back and forth in a second direction perpendicular to the first direction;

forming a first transition line extending at a first non-zero angle from the first direction, wherein the first transition line is not parallel to the second direction, the first transition line being formed by a first change in pattern during weaving of the at least one weaving thread, wherein the first transition line extends along an edge of the woven seamed structure;

forming a second transition line extending at a second non-zero angle from the first direction, wherein the second transition line is not parallel to the second direction, the second transition line being formed by a second change in pattern during weaving of the at least one weaving thread, wherein the second transition line extends along the edge of the woven seamed structure; and forming a body from the plurality of threads and the at least one weaving thread, wherein the body includes the first transition line and the second transition line.

* * * * *